US008913909B2

(12) United States Patent
Ogura

(10) Patent No.: US 8,913,909 B2
(45) Date of Patent: Dec. 16, 2014

(54) IMAGE FORMING APPARATUS

(71) Applicant: Canon Kabushiki Kaisha, Tokyo (JP)

(72) Inventor: Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 13/904,568

(22) Filed: May 29, 2013

(65) Prior Publication Data

US 2013/0322908 A1 Dec. 5, 2013

(30) Foreign Application Priority Data

May 31, 2012 (JP) ..... 2012-125023
Apr. 26, 2013 (JP) ..... 2013-094192

(51) Int. Cl.
*G03G 15/20* (2006.01)
*G03G 15/00* (2006.01)

(52) U.S. Cl.
CPC ..... *G03G 15/80* (2013.01); *G03G 15/2046* (2013.01); *G03G 2215/2035* (2013.01)
USPC ..... 399/69; 399/67; 399/88

(58) Field of Classification Search
CPC ..... G03G 15/80; G03G 15/2035; G03G 15/2046; G03G 15/2078; G03G 15/5004
USPC ..... 399/67, 69, 88
See application file for complete search history.

(56) References Cited

U.S. PATENT DOCUMENTS 8,200,113 B2 * 6/2012 Takami ..... 399/69
8,744,296 B2 * 6/2014 Fukuzawa et al. ..... 399/69
2012/0155905 A1 6/2012 Ogura

FOREIGN PATENT DOCUMENTS

JP 5-333726 A 12/1993

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a fixing portion including an endless belt, a heater, a back-up member, the heater including first heat generating elements; and a controller for controlling power supplied to the first element and the second element in accordance with a temperature of the fixing portion; wherein the power controller supplies the power to the first element and the second element so that a feeding speed V1 of the sheet at the fixing nip, a distance A between the first element and the second element, a ratio Pin % of total power supplied to the first element and the second element set in accordance with the temperature of the fixing portion, a ratio E203(*t*) % of power supplied to the first element at timing t, and a ratio E204(*t*) % of power supplied to the second element at timing t the following equation, E203(*t*)+E204(*t*)+(A/V1))≅Pin.

19 Claims, 20 Drawing Sheets

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 30.68 | 0 | 30.68 | 61.36 | 61.36 | 30.68 | 0 | 30.68 |
| HTR 204 | $P_{204}(t)$ | 50 | 50 | 100 | 50 | 0 | 0 | 50 | 100 |
| | $E_{204}(t)$ | 19.32 | 19.32 | 38.64 | 19.32 | 0 | 0 | 19.32 | 38.64 |

Pin=50% FEEDING SPEED V1

Pin=50% FEEDING SPEED V1

(a)

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 30.68 | 0 | 30.68 | 61.36 | 61.36 | 30.68 | 0 | 30.68 |
| HTR 204 | $P_{204}(t)$ | 50 | 50 | 100 | 50 | 0 | 0 | 50 | 100 |
| | $E_{204}(t)$ | 19.32 | 19.32 | 38.64 | 19.32 | 0 | 0 | 19.32 | 38.64 |

CNTRL PTRN A Pin=50% FEEDING SPEED V1

(b)

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 30.68 | 0 | 30.68 | 61.36 | 61.36 | 30.68 | 0 | 30.68 |
| HTR 204 | $P_{204}(t)$ | 100 | 50 | 50 | 100 | 50 | 0 | 0 | 50 |
| | $E_{204}(t)$ | 38.64 | 19.32 | 19.32 | 38.64 | 19.32 | 0 | 0 | 19.32 |

CNTRL PTRN B Pin=50% FEEDING SPEED V2

FIG.11

(a) PWR CORRESPONDING TO HEAT APPLIED TO SHEET

Pin=50% FEEDING SPEED V1

(b) PWR CORRESPONDING TO HEAT APPLIED TO SHEET

Pin=50% FEEDING SPEED V2

(a)

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 9.09 | 0 | 9.09 | 18.18 | 18.18 | 9.09 | 0 | 9.09 |
| HTR 204 | $P_{204}(t)$ | 50 | 0 | 100 | 50 | 50 | 100 | 0 | 50 |
| | $E_{204}(t)$ | 13.64 | 0 | 27.27 | 13.64 | 13.64 | 27.27 | 0 | 13.64 |
| HTR 205 | $P_{205}(t)$ | 40 | 50 | 75 | 40 | 50 | 20 | 20 | 75 |
| | $E_{205}(t)$ | 21.81 | 27.27 | 40.9 | 21.81 | 27.27 | 10.9 | 10.9 | 40.9 |

CNTRL PTRN A Pin=50% FEEDING SPEED V1

(b)

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 9.09 | 0 | 9.09 | 18.18 | 18.18 | 9.09 | 0 | 9.09 |
| HTR 204 | $P_{204}(t)$ | 50 | 0 | 100 | 50 | 50 | 100 | 0 | 50 |
| | $E_{204}(t)$ | 13.64 | 0 | 27.27 | 13.64 | 13.64 | 27.27 | 0 | 13.64 |
| HTR 205 | $P_{205}(t)$ | 60 | 50 | 65 | 60 | 15 | 65 | 50 | 15 |
| | $E_{205}(t)$ | 32.72 | 27.27 | 35.45 | 32.72 | 8.18 | 35.45 | 27.27 | 8.18 |

CNTRL PTRN B Pin=50% FEEDING SPEED V2

FIG.14

(a) PWR CORRESPONDING TO HEAT APPLIED TO SHEET

Pin=50% FEEDING SPEED V1

(b) PWR CORRESPONDING TO HEAT APPLIED TO SHEET

Pin=50% FEEDING SPEED V2

(a)

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 30.68 | 0 | 30.68 | 61.36 | 61.36 | 30.68 | 0 | 30.68 |
| HTR 204 | $P_{204}(t)$ | 90 | 50 | 50 | 10 | 10 | 50 | 50 | 90 |
| | $E_{204}(t)$ | 34.77 | 19.31 | 19.31 | 3.86 | 3.86 | 19.31 | 19.31 | 34.77 |

CNTRL PTRN A PIN=50% FEEDING SPEED V1

(b)

| | | t1 | t2 | t3 | t4 | t5 | t6 | t7 | t8 |
|---|---|---|---|---|---|---|---|---|---|
| HTR 203 | $P_{203}(t)$ | 50 | 0 | 50 | 100 | 100 | 50 | 0 | 50 |
| | $E_{203}(t)$ | 30.68 | 0 | 30.68 | 61.36 | 61.36 | 30.68 | 0 | 30.68 |
| HTR 204 | $P_{204}(t)$ | 90 | 10 | 10 | 90 | 90 | 10 | 10 | 90 |
| | $E_{204}(t)$ | 34.77 | 3.86 | 3.86 | 34.77 | 34.77 | 3.86 | 3.86 | 34.77 |

CNTRL PTRN B PIN=50% FEEDING SPEED V2

FIG.16

(a) PWR CORRESPONDING TO HEAT APPLIED TO SHEET

Pin=50% FEEDING SPEED V1

(b) PWR CORRESPONDING TO HEAT APPLIED TO SHEET

Pin=50% FEEDING SPEED V2

| | | t1 | t2 | t3 | t4 | t5 | t6 | t7 | t8 |
|---|---|---|---|---|---|---|---|---|---|
| HTR 203 | $P_{203}(t)$ | 50 | 50 | 0 | 100 | 100 | 0 | 50 | 50 |
| | $E_{203}(t)$ | 30.68 | 30.68 | 0 | 61.36 | 61.36 | 0 | 30.68 | 30.68 |
| HTR 204 | $P_{204}(t)$ | 70 | 50 | 10 | 70 | 70 | 10 | 50 | 70 |
| | $E_{204}(t)$ | 27.04 | 19.31 | 3.86 | 27.04 | 27.04 | 3.86 | 19.31 | 27.04 |

PIN=50% FEEDING SPEED V1, V2

FIG.18

(a) PWR CORRESPONDING TO HEAT APPLIED TO SHEET (b) PWR CORRESPONDING TO HEAT APPLIED TO SHEET

| POWER LEVEL (Pin) | 1ST POWER TABLE | | | | | | | |
|---|---|---|---|---|---|---|---|---|
| 40/40(100%) | 100 | 100 | 100 | 100 | 100 | 100 | 100 | 100 |
| ⋮ | | | | ⋮ | | | | |
| 20/40(50%) | 50 | 0 | 50 | 100 | 100 | 50 | 0 | 50 |
| ⋮ | | | | ⋮ | | | | |
| 0/40(0%) | 0 | 0 | 0 | 0 | 0 | 0 | 0 | 0 |

HALF OF AC

ONE CNTRL PERIOD (4CYCLE)

| POWER LEVEL (Pin) | 2ND POWER TABLE | | | | | | | |
|---|---|---|---|---|---|---|---|---|
| 40/40(100%) | 100 | 100 | 100 | 100 | 100 | 100 | 100 | 100 |
| ⋮ | | | | ⋮ | | | | |
| 20/40(50%) | 50 | 50 | 100 | 50 | 0 | 0 | 50 | 100 |
| ⋮ | | | | ⋮ | | | | |
| 0/40(0%) | 0 | 0 | 0 | 0 | 0 | 0 | 0 | 0 |

ONE CNTRL PERIOD (4CYCLE)

FIG.20

| POWER LEVEL (Pin) | 1ST POWER TABLE (SPEED:V1) | | | | | | | |
|---|---|---|---|---|---|---|---|---|
| 40/40(100%) | 100 | 100 | 100 | 100 | 100 | 100 | 100 | 100 |
| ⋮ | | | | ⋮ | | | | |
| 20/40(50%) | 50 | 0 | 50 | 100 | 100 | 50 | 0 | 50 |
| ⋮ | | | | ⋮ | | | | |
| 0/40(0%) | 0 | 0 | 0 | 0 | 0 | 0 | 0 | 0 |

HALF OF AC

ONE CNTRL PERIOD(4CYCLE)

| POWER LEVEL (Pin) | 2ND POWER TABLE (SPEED:V1) | | | | | | | |
|---|---|---|---|---|---|---|---|---|
| 40/40(100%) | 100 | 100 | 100 | 100 | 100 | 100 | 100 | 100 |
| ⋮ | | | | ⋮ | | | | |
| 20/40(50%) | 50 | 50 | 100 | 50 | 0 | 0 | 50 | 100 |
| ⋮ | | | | ⋮ | | | | |
| 0/40(0%) | 0 | 0 | 0 | 0 | 0 | 0 | 0 | 0 |

ONE CNTRL PERIOD(4CYCLE)

| POWER LEVEL (Pin) | 1ST POWER TABLE (SPEED:V2) | | | | | | | |
|---|---|---|---|---|---|---|---|---|
| 40/40(100%) | 100 | 100 | 100 | 100 | 100 | 100 | 100 | 100 |
| ⋮ | | | | ⋮ | | | | |
| 20/40(50%) | 50 | 0 | 50 | 100 | 100 | 50 | 0 | 50 |
| ⋮ | | | | ⋮ | | | | |
| 0/40(0%) | 0 | 0 | 0 | 0 | 0 | 0 | 0 | 0 |

| POWER LEVEL (Pin) | 2ND POWER TABLE (SPEED:V2) | | | | | | | |
|---|---|---|---|---|---|---|---|---|
| 40/40(100%) | 100 | 100 | 100 | 100 | 100 | 100 | 100 | 100 |
| ⋮ | | | | ⋮ | | | | |
| 20/40(50%) | 100 | 50 | 50 | 100 | 50 | 0 | 0 | 50 |
| ⋮ | | | | ⋮ | | | | |
| 0/40(0%) | 0 | 0 | 0 | 0 | 0 | 0 | 0 | 0 |

FIG.21

IMAGE FORMING APPARATUS

FIELD OF THE INVENTION AND RELATED ART

The present invention relates to an image forming apparatus which has a fixing device for fixing a toner image to recording medium.

In the field of an image forming apparatus such as a copying machine, a laser beam printer, etc., a thermal fixing device has long been known, which employs a ceramic heater (as its heat source), and an endless film through which the heat from the heat source is applied to a sheet of recording medium and a toner image thereon, to fix the toner image to the sheet of recording medium. The ceramic heater is made up of a ceramic substrate and a heat generating member formed on the substrate by printing. In an image forming operation, an unfixed image on a sheet of recording medium is heated though the film by the heater. As for the method for controlling the electric power supplied to the heat generating member, there are phase control, wave number control, hybrid control, etc. The hybrid control is a combination of the phase control and wave number control. The heater is controlled in temperature with the use of one of these controls. More concretely, the heating element of the heater is turned on or off while a sheet of recording medium is moved in contact, or virtually in contact, with the sheet of recording medium. Thus, some areas of the sheet of recording medium move past the heating element while the heating element is supplied with electric power, whereas the other areas are move past the heating element while the heating element is not supplied with electric power. In other words, some areas of the sheet of recording medium are heated by the heating element itself, whereas the other areas of the sheet of recording medium are not heated by the heating element itself. Thus, it is possible that after the fixation of the unfixed toner image to the sheet of recording medium, the resultant image will appear nonuniform in density (which hereafter may be referred to simply as "nonuniform fixation"). Generally speaking, wave number control and hybrid control are longer in control cycle than phase control. Therefore, in a case where the heater is supplied with electric power directly from a commercial electric power source (50 Hz or 60 Hz), the nonuniform fixation is likely to be more noticeable when wave number control or hybrid control is used to control the power supply to the heater than when phase control alone is used. Further, in a case where the heater is provided with two or more heating elements positioned in parallel in such a manner that the lengthwise direction of the heating elements become perpendicular to the direction in which recording medium is conveyed, the noticeablity of the nonuniform fixation is affected by the total amount of heat applied to a given point (area) of a sheet of recording medium and the toner image thereon, by the combination of the multiple heating elements. For example, in a case where the heater is provided with two heating elements, some areas of a sheet of recording medium may be heated by both heating elements, whereas the other areas of the sheet of recording medium may be heated by neither of the two heating elements, which results in the nonuniform fixation. The amount of difference in density between an area of a fixed image, which is high in density, and an area of the fixed image, which is low in density, and the periodicity of the nonuniformity, etc., of this nonuniformity in density attributable to nonuniform fixation is affected by the relationship among the distance between the adjacent two heating elements, recording medium conveyance speed, and method used for controlling the power supply to the heating elements.

Thus, there has been proposed a method for optimally setting the distance between the adjacent two heating elements in order for a given area of a sheet of recording medium, which is heated by one of the two heating elements, not to be heated by the second heating element, and also, in order to heat the areas of the sheet of recording medium, which are not heated by one of the two heating elements, with the second heating element so that the sheet of recording medium becomes uniform in the amount of heat given thereto. For example, Japanese Laid-open Patent Application H05-333726 discloses a method for determining the optimal heating element interval for an apparatus having multiple (two) heating elements controlled by phase control or wave number control, according to the frequency of the AC power source and the recording medium speed of the apparatus.

However, if a fixing device is designed to use the method, disclosed in Japanese Laid-open Patent Application H05-333726, for minimizing a fixing apparatus in nonuniform fixation, the heating element interval is set based on the method used by the apparatus to control the amount by which its heating elements are supplied with electric power. The optimal heating element distance is affected by such factors as toner characteristic, heater substrate width, etc. Thus, using the above described method substantially reduces in latitude the fixing device in terms of design.

SUMMARY OF THE INVENTION

The present invention was made in view of the above described issues. Thus, the primary object of the present invention is to provide an image forming apparatus which can output a high quality image, more specifically, an image which is significantly less in nonuniformity attributable to fixation than any image outputted by an image forming apparatus in accordance with prior art.

Another object of the present invention is to provide an image forming apparatus which is significantly higher in latitude in terms of design than any image forming apparatus in accordance with the prior art.

According to an aspect of the present invention, there is provided an image forming apparatus comprising: an image forming station for forming an unfixed image on a recording material; a fixing portion for fixing an unfixed image formed on the recording material thereon, said fixing portion including an endless belt, a heater contacted to an inner surface of said endless belt, a back-up member forming a fixing nip for nipping and feeding the recording material together with said heater through said endless belt, said heater including a first heat generating element and a second heat generating element provided at a position downstream of said first heat generating element with respect to a feeding direction of the recording material; and an electric power control portion for controlling electric power supplied to said first heat generating element and said second heat generating element in accordance with a temperature of the fixing portion; wherein said electric power control portion supplies the electric power to said first heat generating element and said second heat generating element so that a feeding speed V1 of the recording material at the fixing nip, a distance A between said first heat generating element and said second heat generating element, a ratio Pin (%) of total electric power supplied to said first heat generating element and said second heat generating element set in accordance with the temperature of said fixing portion relative to maximum total electric power supplyable to said first heat generating element and said second heat generating element, a ratio E203(*t*) (%) of electric power supplied to said first heat generating element at timing t relative to the maximum total electric power, and a ratio E204(*t*) (%) of electric power supplied to said second heat generating element at timing t relative to the maximum total electric power, satisfy the following equation, $$E_{203}(t) + E_{204}\left(t + \frac{A}{V1}\right) \cong Pin$$

According to another aspect of the present invention, there is provided an image forming apparatus comprising an image forming station for forming an unfixed image on a recording material; a fixing portion for fixing an unfixed image formed on the recording material thereon, said fixing portion including an endless belt, a heater contacted to an inner surface of said endless belt, a back-up member forming a fixing nip for nipping and feeding the recording material together with said heater through said endless belt, said heater including a first heat generating element and a second heat generating element provided at a position downstream of said first heat generating element with respect to a feeding direction of the recording material; and an electric power control portion for controlling electric power supplied to said first heat generating element and said second heat generating element in accordance with a temperature of the fixing portion, said electric power control portion selecting an electric power level Pin (%) from a plurality of electric power levels in accordance with a temperature of the fixing portion, for each control cyclic period comprising a plurality of successive half-cycles of an AC waveform; wherein at least one electric power level of the plurality of electric power levels is set so that a feeding speed V1 of the recording material at the fixing nip, a distance A between said first heat generating element and said second heat generating element, a ratio E203(*t*) (%) of electric power supplied to said first heat generating element at timing t, and a ratio E204(*t*) (%) of electric power supplied to said second heat generating element at timing t, satisfy the following equation, $$E_{203}(t) + E_{204}\left(t + \frac{A}{V1}\right) \cong Pin$$

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 11 is a table which shows an example of the actual pattern in which electric power is supplied to the heating elements in the second embodiment.

FIG. 14 is a table which shows the actual patterns in which electric power is supplied to the three heating elements, one for one, in the third embodiment.

FIG. 16 is a table which shows an example of the actual pattern in which electric power is supplied to the heating elements in the fourth embodiment.

FIG. 18 is a table which shows an example of the actual pattern in which electric power was supplied to the heating elements in the sixth embodiment.

FIG. 20 is a power supply table for the fixing device in the first embodiment of the present invention.

FIG. 21 is a power supply table for the fixing device in the second embodiment of the present invention.

DESCRIPTION OF THE PREFERRED EMBODIMENTS

Hereafter, the embodiments of the present invention are described in detail with reference to the appended drawings. However, the measurement, material, and shape of the structural components in the following embodiments of the present invention, positional relationship among the structural components, etc., are to be altered as necessary according to the structure of the apparatus to which the present invention is applied, and various conditions under which the apparatus is to be operated. That is, the following embodiments of the present invention are not intended to limit the present invention in scope.

Embodiment 1

(General Structure of Image Forming Apparatus)

Figure 1:
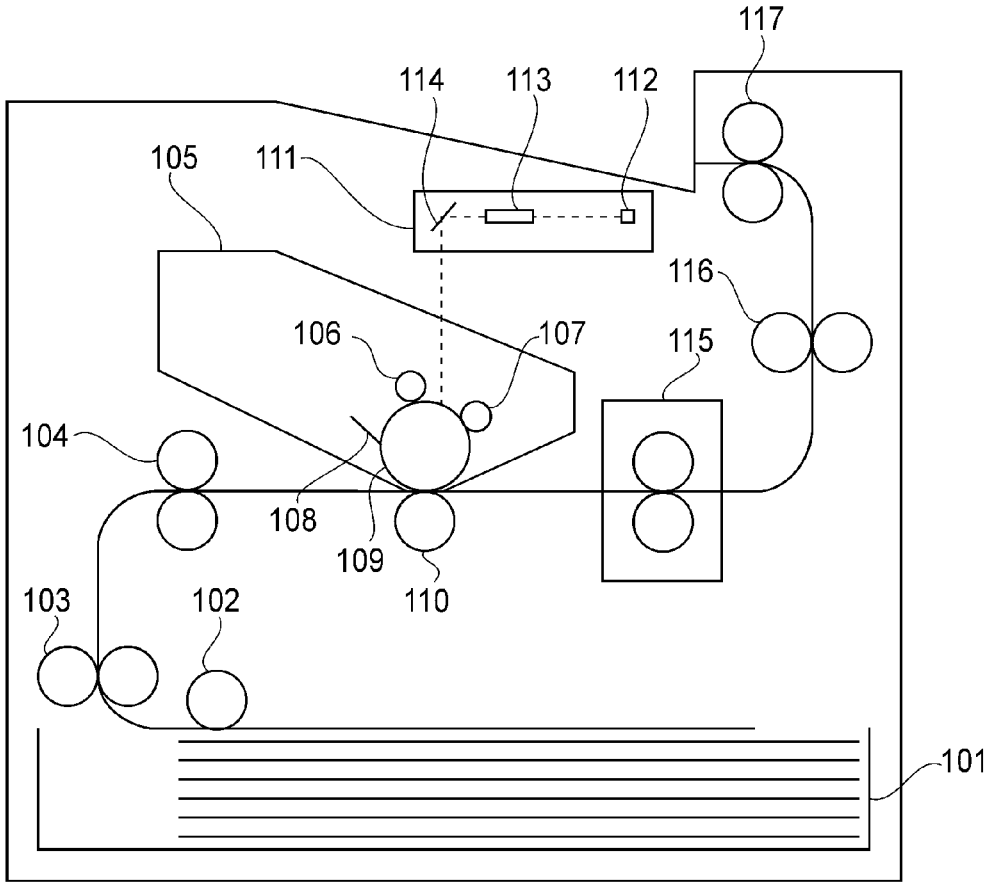
FIG. 1 is a sectional view of a typical image forming apparatus to which the present invention is applicable, and shows the general structure of the apparatus.

First, referring to FIG. 1, the general structure of the image forming apparatus in this embodiment is described. The image forming apparatus is provided with a sheet feeder cassette 101 in which multiple sheets of recording medium can be stored in layers, and which is placed in the bottom portion of the apparatus. As an image formation start signal is inputted into the apparatus, the sheets of recording medium stored in layers in the sheet feeder cassette 101 are fed one by one into the main assembly of the apparatus by a pickup roller 102, and are conveyed toward a pair of registration rollers 104 by a pair of recording medium conveyance rollers 103. Then, each sheet of recording medium is conveyed by the registration rollers 104 to a process cartridge (which function as image formation station) with a preset timing. The process cartridge 105 is made up of a charge roller 106, a development roller 107, a cleaning member 108, a photosensitive drum 109 (which is electrophotographic photosensitive member), and a shell (cartridge) in which the preceding components are integrally placed. The image forming apparatus and process cartridge are structured so that the latter is removably installable in the main assembly of the former.

The image forming apparatus forms an image on a sheet of recording medium through the following steps. First, the peripheral surface of the photosensitive drum 109 is uniformly charged by the charge roller 106. Then, the uniformly charged portion of the peripheral surface of the photosensitive drum 109 is exposed by a scanner unit 111, which is an exposing means. More specifically, the scanner unit 111 contains a laser diode 112, a rotational polygon mirror 113, and a deflection mirror 114. As a beam of laser light is emitted from the laser diode 112, the beam is made to scan the uniformly charged portion of the peripheral surface of the photosensitive drum 109 in the direction (primary scan direction) which is perpendicular to the rotational direction of the photosensitive drum 109, by the polygon mirror 113 and deflection mirror 114, while being made to scan the uniformly charged portion of the peripheral surface of the photosensitive drum 109 in the direction (secondary scan direction) which is parallel to the rotational direction of the photosensitive drum 109, by the rotation of the photosensitive drum 109. Consequently, a two-dimensional latent image is effected on the peripheral surface of the photosensitive drum 109.

The latent image effected on the peripheral surface of the photosensitive drum 109 is developed into a visible image, that is, an image formed of toner, by the toner supplied by the development roller 107. Then, the toner image is transferred in the nip between a transfer roller 110 and photosensitive drum 109, onto the sheet of recording medium conveyed to the nip. Then, the sheet of recording medium, onto which the toner image has just been transferred, is conveyed to a fixing device 115 (fixation station). In the fixing device 115, the unfixed toner image on the sheet of recording medium is subjected to heat and pressure. Thus, the unfixed toner image becomes fixed to the sheet of recording medium. Thereafter, the sheet of recording medium is conveyed further by a pair of intermediary discharge roller 116. Then, it is discharged from the main assembly of the image forming apparatus, ending thereby the sequence for printing an image on the sheet of recording medium.

(General Structure of Fixing Device)

Figure 3:
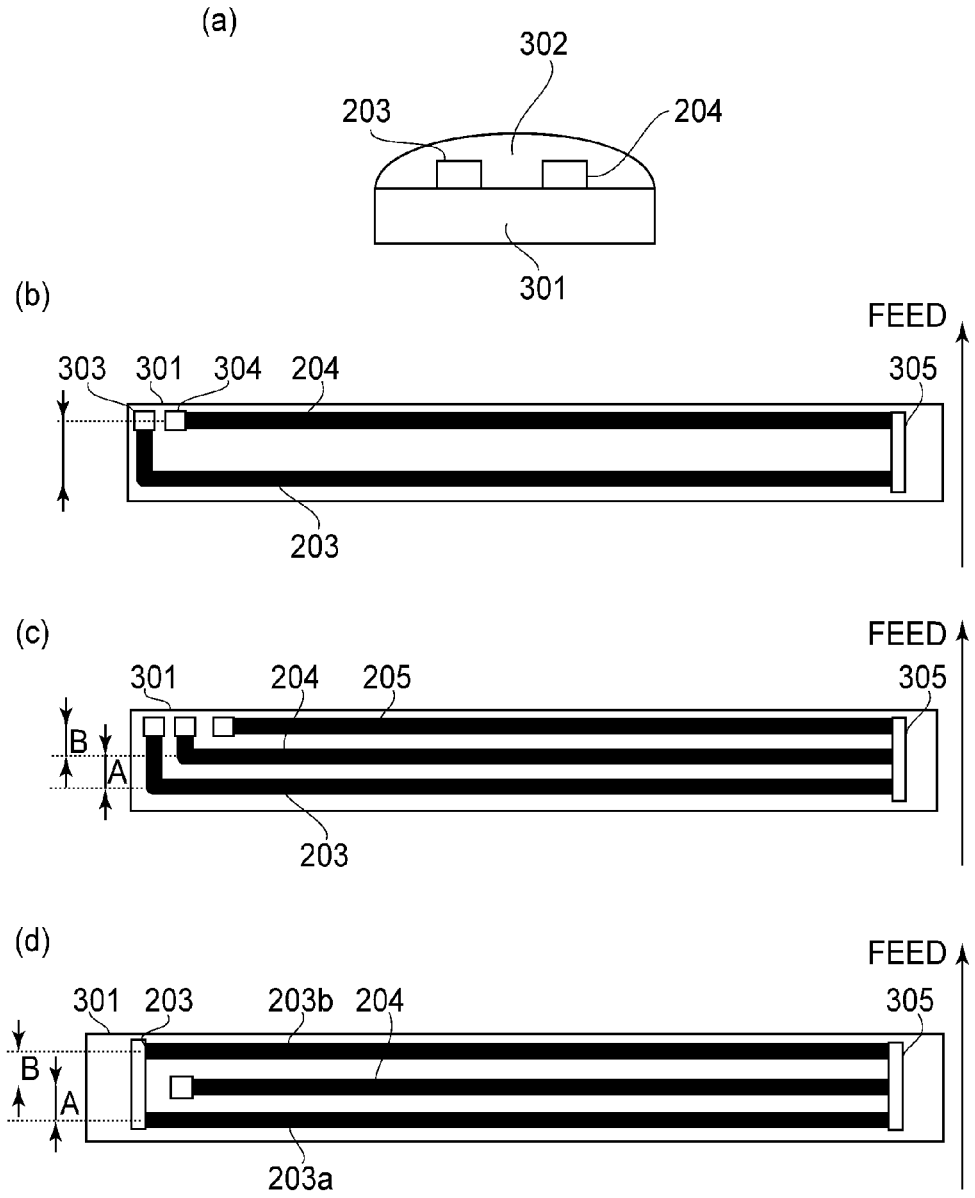
FIGS. 3(*a*), 3(*b*), 3(*c*) and 3(*d*) are plan views of the ceramic heaters, one for one, with which the present invention is compatible, and shows the general structure of the heaters.
Figure 4:
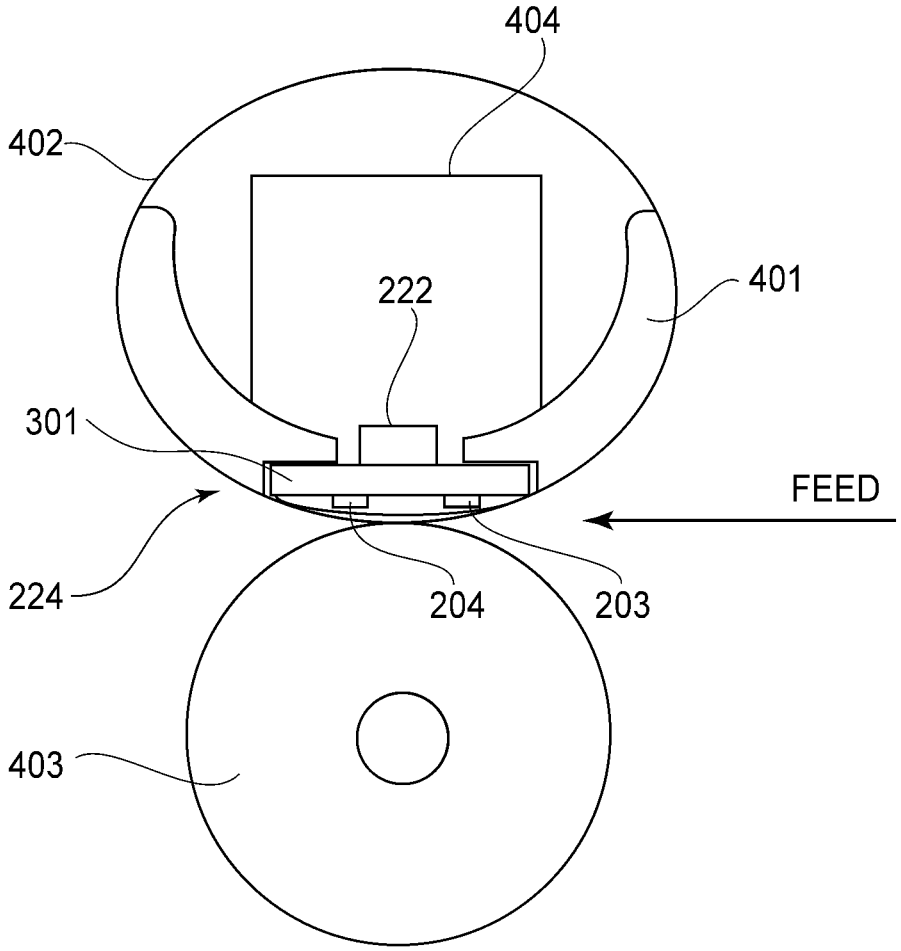
FIG. 4 is a sectional view of a typical fixing device to which the present invention is applicable, and shows the general structure of the device.

Next, referring to FIGS. 3 and 4, the general structure of the fixing device 115 is described. FIG. 4 shows the general structure of the fixing device 115. The fixing device 115 is of the so-called heating film type. It has a heating sleeve 402 (endless belt), and an elastic pressure roller 403 (pressure applying member) kept pressed upon the heating sleeve 402. The heating sleeve 402 is fitted around a sleeve guide 401 (film guide), and is rotated by the rotation of the elastic pressure roller 403. As the pressure roller 403 is kept pressed against the sleeve guide 401 with the presence of the heating sleeve 402 between the pressure roller 403 and sleeve guide 401, a nip (fixation nip), which has a preset width, is formed between the heating sleeve 402 and pressure roller 403. The toner image on the sheet of recording medium is fixed to the sheet in the fixation nip. The fixing device 115 is also provided with a rigid stay 404 which is placed on the inward side of the sleeve guide 401, with the reference to the loop which the heating sleeve 402 forms.

Further, the fixing device 115 is provided with a ceramic heater 224 (heater) attached to the bottom surface (in FIG. 4) of the sleeve guide 401. The ceramic heater 224 is on the inward side of the heating sleeve 402. It is a long and narrow heater, and is positioned so that its lengthwise direction becomes perpendicular to the rotational direction of the heating sleeve 402. The elastic pressure roller 403 is kept pressed upon the heating sleeve 402, with the presence of the ceramic heater 224 and heating sleeve 402 between itself and the 222.

The ceramic heater 224 has a dielectric ceramic substrate 301 formed of SiC, AlN, $Al_2O_3$, or the like, and a pair of heating elements 203 (first heating element) and 204 (second heating element) formed on the dielectric substrate 301 by paste-printing or the like method. The two heating elements 203 and 204 extend in the lengthwise direction of the dielectric substrate 301. The surface of the heating element 203, which comes into contact with the heating sleeve 402, and the surface of the heating element 204, which comes into contact with the heating sleeve 402, are protected by a protective layer 302 formed of glass or the like substance. The opposite surface of the dielectric substrate 301 from the surface which has the heating elements 203 and 204 has a thermistor 222 as a temperature detection element. Further, the ceramic heater 224 is also provided with a thermistor 223 (FIG. 2), a thermoswitch, or the like, which is for detecting the temperature of one of the lengthwise end portions of the ceramic heater 224.

The heating elements 203 and 204 may be made so that they are uniform in electrical resistance value in terms of their lengthwise direction, or so that their center portions are different in electrical resistance value from their lengthwise end portions. For example, in a case where a small sheet of recording medium is to be heated, the lengthwise end portions of the heater 224 are outside the path of the sheet of recording medium, and therefore, are likely to become higher in temperature than the center portion of the heater 224. Thus, in order to keep the heater 224 uniform in temperature in terms of its lengthwise direction, the heating elements 203 and 204 may be made so that their lengthwise end portions are different in electrical resistance value from their center portion. Incidentally, a heater made so that its lengthwise end portions are different in electrical resistance value from its center portion is referred to as a "tapered heater". Further, in order to make it easier for the heating sleeve 402 to slide on the heater 224, the interface between the heating sleeve 402 and ceramic heater 224 may be provided with grease or the like. Further, the heating elements 203 and 204 of the ceramic heater 224 may be on the opposite surface of the dielectric ceramic substrate 301 from the nip, instead of the surface of the dielectric ceramic substrate 303, which faces the nip.

In the case of the fixing device 115 of the heating film type, which was described above, the inward surface of the heating sleeve 402 directly contacts the ceramic heater 224. Therefore, the heat generated by the ceramic heater 224 is highly efficiently given to the fixation nip. Therefore, the fixing device 115 is very effective in that it can heat a toner image at a satisfactory temperature level, is smaller in power consumption, and is short in the length of startup time.

(Structure of Electric Power Supply Circuit)

Figure 2:
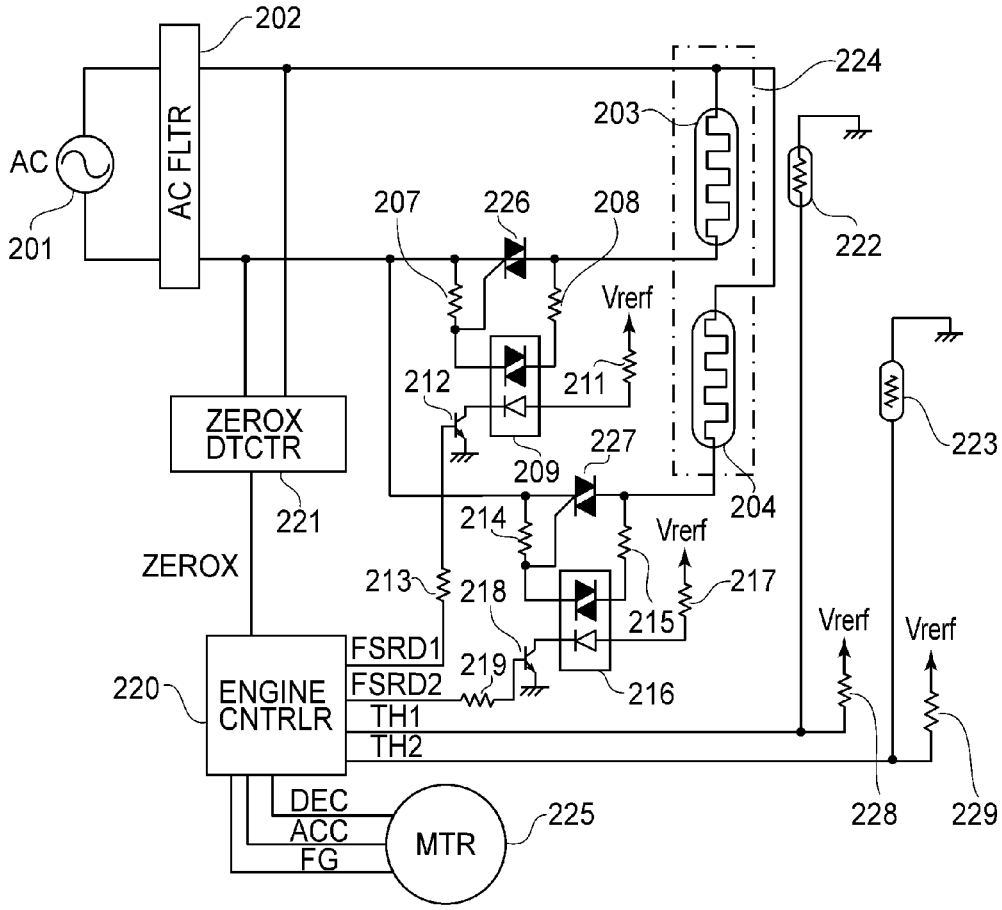
FIG. 2 is a drawing of the electrical circuit for supplying the fixing device of the image forming apparatus shown in FIG. 1, with electric power, and shows the general structure of the circuit.

Next, referring to FIG. 2, the electric power supply circuit for supplying the heating elements 203 and 204 of the fixing device 115 with electric power is described. A referential code 201 in FIG. 2 stands for an AC power source (commercial power source), which is in connection to the heating elements 203 and 204 by way of an AC filter 202. The heating elements 203 and 204 are connected in parallel. Thus, the electric power to be supplied to the heating element 203 from the AC power source 201, and the electric power to be supplied to the heating element 204 from the AC power source 201, can be independently controlled from each other.

More specifically, the heating element 203 is driven by a triac 226, whereas the heating element 204 is driven by a triac 227. Referential codes 207 and 208 stand for the bias resistors for the triac 226. A referential code 209 stands for a photo-triac coupler for securing a proper amount of creepage distance between the primary and secondary sides of the electrical power source. As electric power is supplied to the light emitting diode of the photo-triac coupler 209, the triac 226 is turned on. A referential code 211 stands for a resistor for regulating the electric current which flows to the photo-triac coupler 209. A referential code 212 stands for a transistor for turning on or off the photo-triac coupler 209.

The transistor 212 reacts to a signal FSRD 1 sent thereto from an engine controller 220 by way of a resistor 213. The engine controller 220 is equivalent to an electric power controller capable of controlling the electric power to be supplied to the heating element 203, and the electric power to be supplied to the heating element 204, independently from each other. The signal FSRD1 is set to "high" when it is necessary for the transistor 212 to be turned on to turn on the photo-triac coupler 209. It is set to "low" when it is necessary for the transistor 212 to be turned off the photo-triac 209.

Referential codes 214 and 215 are bias resistors for the triac 227. A referential code 216 stands for a photo-triac coupler for securing a creepage distance between the primary and secondary sides of the electrical power source. As electric power is supplied to the light emitting diode of the photo-triac coupler 216, the triac 227 is turned on. A referential code 217 stands for a resistor for regulating the electric current which flows to the photo-triac coupler 216. A referential code 218 stands for a transistor for turning on or off the photo-triac coupler 216. The transistor 218 reacts to a signal FSRD2 sent thereto from the engine controller 220 by way of the resistor 219.

A referential code 221 stands for a zero-crossing point detection circuit which is in connection to the AC power source 201 by way of an AC filter 202. The zero-crossing point detection circuit 221 sends a pulse signal (which hereafter may be referred to as "zero-crossing point detection signal") to the engine controller 220 to inform the engine controller that the AC power source voltage is no more than a threshold value. The engine controller 220 detects the edge of the zero-crossing point signal, and turns on or off the triacs 226 and 227 by phase control, wave number control, and/or hybrid control, which will be described later.

The referential code 222 stands for the thermistor for detecting the temperature of the heater 224. The thermistor 222 is positioned on the ceramic heater 224, with the placement of a dielectric member high enough in withstand voltage, between itself and the heating elements 203 and 204, in order to secure a sufficient amount of dielectric distance between the thermistor 222 and the heating elements 203 and 204. The thermistor 223 is for detecting the temperature of one of the lengthwise end portions of the ceramic heater 224. The thermistor 223 is positioned on the ceramic heater 224, with the placement of a dielectric member high enough in withstand voltage, between itself and the heating elements 203 and 204, in order to secure a sufficient amount of dielectric distance between itself and the heating elements 203 and 204.

The temperature detected by the thermistor 222 and the temperature detected by the thermistor 223 are detected as the partial voltage between the resistor 228 and thermistor 222, and the partial voltage between the resistor 229 and thermistor 223, respectively, and are inputted into the engine controller 220 after being converted from analog signal into a digital signal. The temperature of the ceramic heater 224 is monitored by the engine controller 220, and is compared with the temperature value stored in the engine controller 220, to calculate the amount by which electric power is to be supplied to the heating elements 203 and 204. The thus obtained amount by which electric power is to be supplied to the heating elements 203 and 204 is converted into the phase angle or wave number, according to which the engine controller 220 sends signals FSRD and FSRD2 to the transistors 212 and 218, respectively.

The signal FSRD1 is for driving the transistor 212 to make the photo-triac coupler 209 to emit light. The signal FSRD2 is for driving the transistor 218 to make the photo-triac coupler 216 emit light. Hereafter, the signals FSRD1 and FSRD2 may be referred to simply as FSRD1 and FSRD2, respectively. The amount by which electric power to be supplied to the heating element 203, and the amount by which electric power is to be supplied to the heating element 204, are controlled with the use of these FSRD1 and FSRD2. As described above, the first and second heating elements 203 and 204 can be independently controlled from each other, by the engine controller 220.

A referential code 225 stands for a motor used as a mechanical power source of the system for conveying a sheet of recording medium, and also, as mechanical power source for driving the photosensitive drum 109. The engine controller 220 detects the speed of the motor 225 by receiving a speed signal pulse (FG) sent from the motor 225. Further, the engine controller 220 compares the FG signal with the referential clock, and outputs an acceleration signal or a deceleration signal, based on the results of the comparison, to control the recording medium conveyance speed and process speed. Further, the engine controller 220 can issue a command to change the motor 225 in rotational speed in order to change the recording medium conveyance speed according to the size of a sheet of recording medium, or the like factor. In this embodiment, however, the motor 225 is not changed in rotational speed.

Next, referring to FIGS. 3(*a*), 3(*b*), 3(*c*) and 3(*d*), the points of connection between the ceramic heater 224 and the above described electric power supply circuit are described. FIG. 3(*a*) is a schematic sectional view of the ceramic heater 224. The structure of the ceramic heater 224 is as described above. FIGS. 3(*b*), 3(*c*) and 3(*d*) are plan views of three ceramic heaters 224, one for one, which are different in the shape and configuration of their heating elements. Although FIG. 3 shows only three heaters different in the shape and configuration of their heating elements, these heaters are not intended to limit the present invention in scope in terms of the shape and configuration of the heating elements of a heater. That is, in order for the present invention to be applicable to a given heater is that the heater is structured so that it has two more heating elements which are connected in parallel and extend in the direction perpendicular to the recording medium conveyance direction.

The ceramic heater 224 shown in FIG. 3(*b*) is provided with the two heating elements 203 and 204, and three electrodes 303, 304, and 305. The heating elements 203 and 204 may be referred to as the upstream and downstream heating elements, respectively, in terms of the recording medium conveyance direction. The electrodes 303 and 304 are for supplying the heating elements 203 and 204, respectively, with electric power. The electrode 305 is a common electrode for the heating elements 203 and 204. It is in connection to the HOT terminal of the AC power source 201. The electrode 303 is in connection to the triac 226. The electrode 304 is in connection to the triac 227.

(Phase Control and Wave Number Control)

The electric power supply to the heating elements 203 and 204 of the ceramic heater 224 is managed by a combination of phase control and wave number control. Here, phase control and wave number control are described.

Phase control is a method for turning on the ceramic heater 224 at the point in time which corresponds to a specific phase angle in half an oscillatory cycle (half cycle) of an AC power source to control the amount by which electric power is supplied to the ceramic heater 224. In the case of phase control, therefore, each control cycle is equivalent to one half the oscillatory cycle of the AC power. Thus, in phase control, electric current is flowed for every half the waveform. In other words, the electric current flowed by phase control is relatively small in the amount of change, and is short in the interval between the change. That is, phase control is relatively small in the amount of change to the voltage provided by the AC power source, which is attributable to the changes in the load current of electrical devices connected to the AC power source which is also in connection to an illumination device, and the impedance of the wiring. Therefore, phase control is advantageous from the standpoint of preventing the flickering of an illumination device. However, as a heater is turned on or off with the use of phase control, the amount by which electric current flows suddenly changes, which in turn generates high frequency electric current. Therefore, phase control is disadvantageous from the standpoint of minimizing the generation of high frequency electric current.

The wave number control is a method for turning a heater on or off for every half the oscillatory cycle of the AC power source, in order to control the amount by which electric power is supplied to the heater. In wave number control, therefore, the length of each control cycle is equal to the length of half the oscillatory cycle of the AC power supply. When the power supply to a heater is controlled by wave number control, the heater is turned on or off at a point in time which corresponds to the immediate adjacencies of the zero crossing point of the waveform of the AC power source, and therefore, high frequency electric current is unlikely to be generated. Therefore, from the standpoint of minimizing the generation of high frequency electric current, wave number control is advantageous to phase control. However, wave number control is greater in the change in current amount than phase control. Therefore, it is more likely to cause an illumination device to flicker than phase control.

From the standpoint of preventing the generation of high frequency electric current and switching noise, hybrid control, which is a combination of phase control and wave number control, is better than phase control alone. Further, it can control the flickering better than wave number control, and also, can control the power supplied to the heater, in a greater number of steps than wave number control alone. The hybrid control in this embodiment is described later in detail.

(Zero Crossing Point Detection Circuit and Waveform of Zero Crossing Signal)

Figure 5:
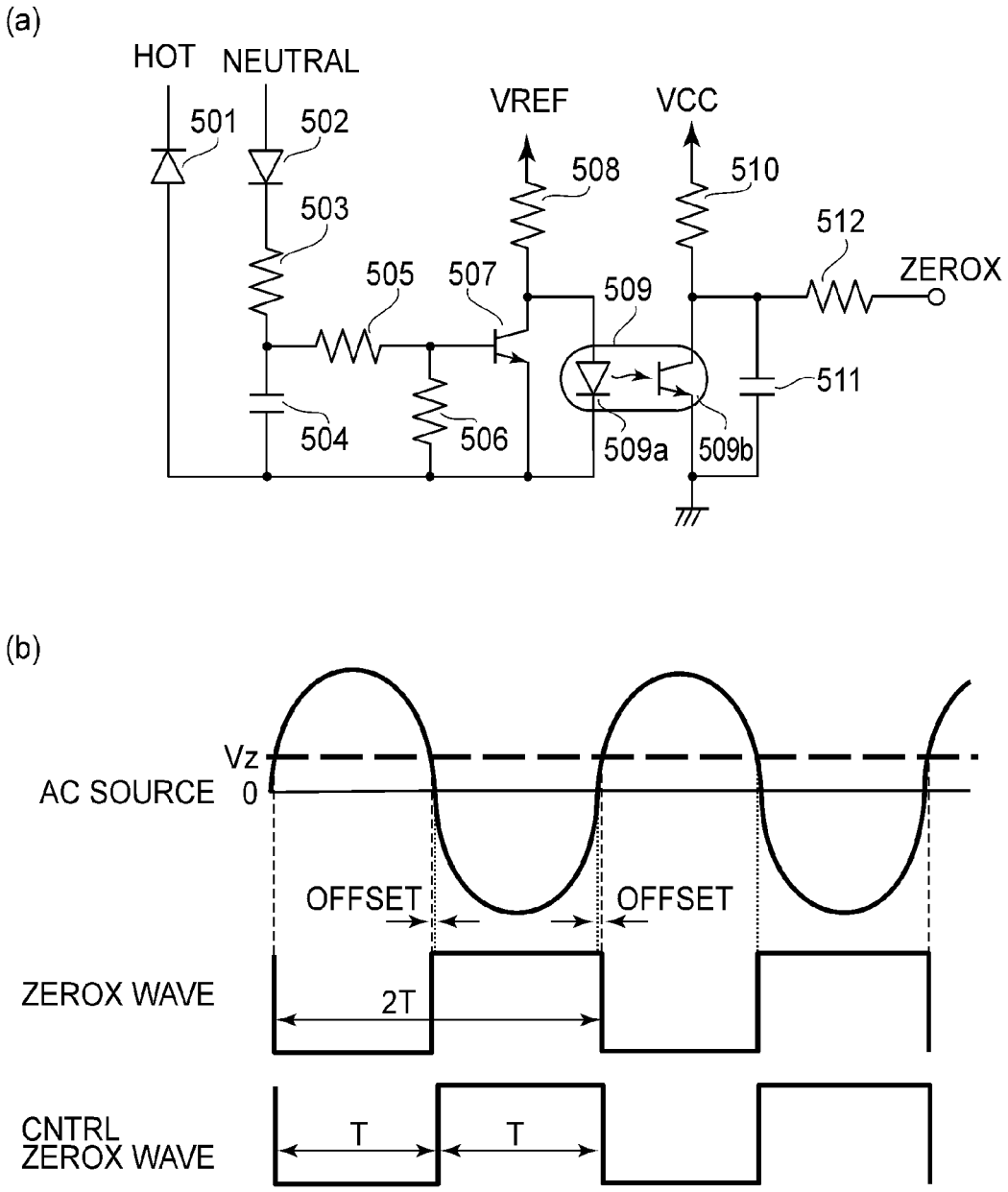
FIG. 5(*a*) is a drawing of the zero-cross point detection circuit compatible with the present invention, and FIG. 5(*b*) is a combination of the AC power source waveform and the waveform of the zero-cross point detection signal.

FIG. 5(*a*) shows the details of the zero-crossing point detection circuit 221. FIG. 5(*b*) shows the waveform of an AC current power source, and the waveform of the zero crossing signal. The AC voltage from the AC power source 201 is inputted into the zero-crossing point detection circuit 221 shown in FIG. 5(*a*), being thereby rectified by rectifiers 501 and 502 into unidirectional current, which corresponds in waveform to half the waveform of the alternating current. In the case of this circuit, the neutral side is rectified. This rectified AC voltage is inputted into the base of the transistor 507 by way of a resistors 505, a condenser 504, and current limiting resistors 503 and 506. In a case where the potential level of the neutral side is higher than the threshold voltage Vz which is determined by an unshown diode bridge which can perform full-wave rectification, or the combination of a rectifiers 501 and 502, and the transistor 507, that is, in a case where the potential level of the neutral side is higher than that of the hot side, the transistor 507 turns on. On the other hand, if the neutral side becomes lower in potential level than the hot side, the transistor 507 turns off.

A photo-coupler 509 is an element for securing a creepage distance between the primary and secondary sides. Resistors 508 and 510 are for limiting the current which flows to the photo-coupler 509. As the neutral side becomes higher in potential level than the hot side, the transistor 507 turns on. Therefore, the light emitting diode 509*a* in the photo-coupler 509 turns off, and the photo-transistor 509*b* turns off, causing thereby the output voltage of the photo-coupler 509 to be high.

On the other hand, if the neutral side becomes lower in potential level than the hot side, the transistor 507 turns off, causing thereby the light emitting diode 509*a* in the photo-coupler 509 to emit light. Thus, the photo-transistor 509*b* turns on, causing thereby the output voltage of the photo-coupler 509 to be low. That is, the zero crossing signal is a pulse signal which changes in potential level according to whether the potential level of the hot side is higher or lower by the amount equal to the threshold voltage Vz, than the potential level of the neutral side.

This output of the photo-coupler 509 is inputted, as a zero crossing point signal, to the engine controller 220 by way of a condenser 511. As the engine controller 220 receives the zero crossing point detection signal, it detects the rising and falling edges of the zero crossing point detection signal, and uses the detected edges as the trigger to turn on or off the triacs 226 and 227.

However, the threshold voltage Vz is not exactly zero in value. Therefore, the leading edge of the zero crossing point detection signal is slightly offset from the true zero crossing point, and so is the trailing edge. Therefore, if this zero crossing point detection signal is used as the trigger signal, without any modification, the length of time, which corresponds to the amount of deviation between the leading edge of the zero crossing point detection signal and the true zero crossing point, and between the trailing edge of the zero crossing point detection signal and the true zero crossing point, becomes the phase deviation attributable to the positivity and negativity of the input power source. Therefore, the engine controller 220 detects the length of the oscillatory cycle (2T) of the trailing edge of the zero crossing point detection signal, and calculates half (T) the length of the oscillatory cycle (2T). Then, it creates a pseudo leading edge within a length T of time, in itself. Hereafter, a combination of the trailing edge and the pseudo leading edge is referred to as "control zero crossing signal edge". The engine controller 220 uses this control zero crossing point detection signal, as the trigger signal for controlling the triacs.

(Hybrid Control)

Figure 6:
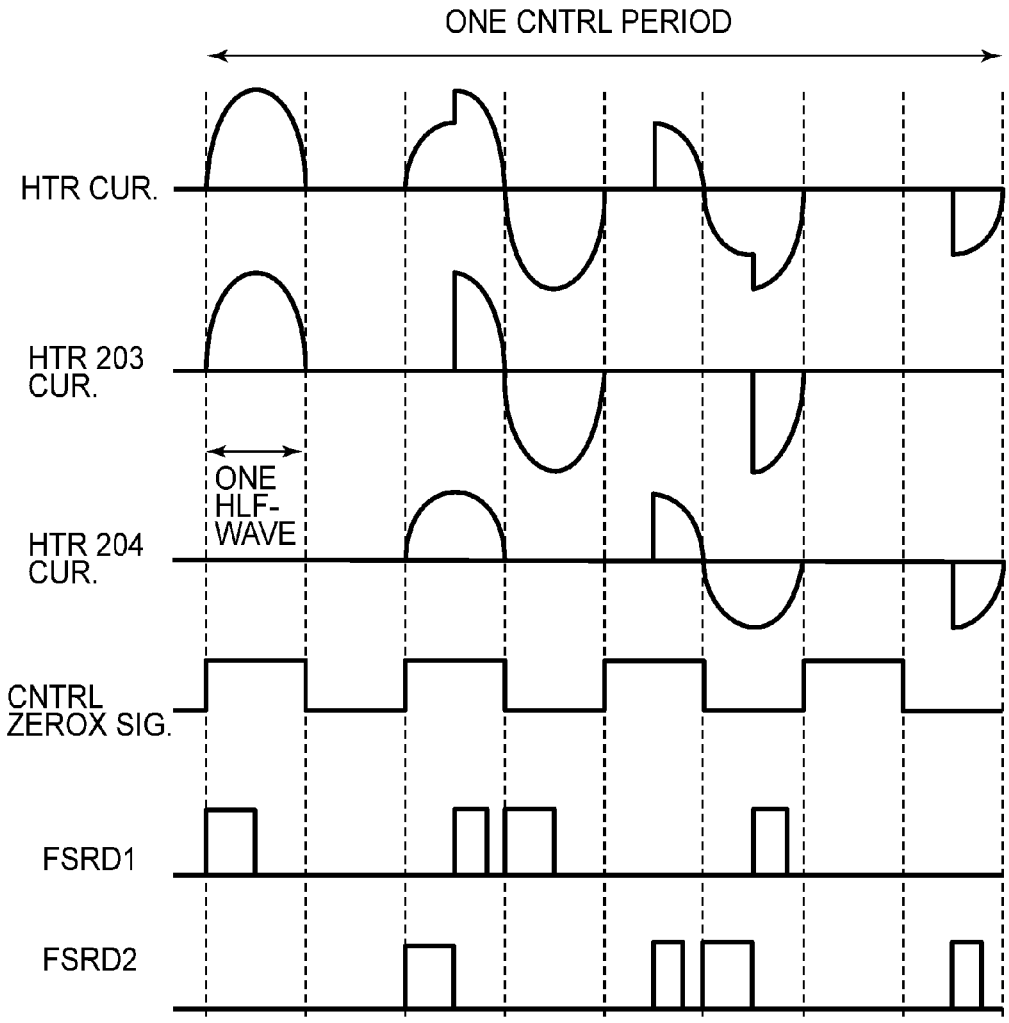
FIG. 6 is a drawing for showing various waveforms in which electric current can be supplied to the heating elements of the heater of the fixing device which is in accordance with the present invention.

Next, referring to FIG. 6, the hybrid control in this embodiment is described. As described above, hybrid control is a combination of wave number control which turns on or off the electric power supply from an AC power source at a point in time which corresponds to the leading or trailing edge of the waveform of the AC voltage, within each control period, and phase control which turns on or off the electric power supply from an AC power at a point in time, which corresponds to a specific point of the waveform of the AC power source, within half the waveform. That is, it is a combination of wave number control which is less suitable to control the "flickering" which indicates the presence of voltage fluctuation, but is less likely to generate high frequency current, and wave number control which is more suitable for controlling "flickering", but, is likely to generate high frequency current. Therefore, hybrid control may be said to be such a control method that is balanced in the effects of causing the "flickering" and the effect of generating high frequency current. For example, if it is assumed that each control cycle corresponds to continuous eight halves (four cycle) of the waveform of the AC power source, it is possible to change the number of the halves of waveform, during which electric power is to be supplied to a heater, and the phase angle at which electric power begins to be supplied to the heater, in order to control the amount by which electric power is supplied to the heater.

The waveform of the FSRD1 and the waveform of the FSRD2 are the waveforms of the FSRD1 and FSRD2 outputted by the engine controller 220 described referring to FIG. 2. They are waveforms of the signal, described with reference to FIG. 5, outputted by the zero crossing point detection circuit. In a case where hybrid control is used, a heater is turned on when the phase angle is zero, or at an optional phase angle. Therefore, the FSRD1 and FSRD2 become pulse signals, which start up at a desired phase angle and end at a desired phase angle, with reference to the control zero crossing point detection signal.

The waveform of the electric current which flows to the heating elements 203 and 204 while being controlled by the FSRD1 and FSRD2, respectively, are reflected upon the waveform of the electric current which flows through the heating element 203, and the waveform of the electric current which flows through the heating element 204, respectively. In this embodiment, the heating elements 203 and 204 are different in the amount of resistance. Therefore, the electric current which flows through the heating element 203, and the electric current which flows through the heating element 204, are different in the amplitude of waveform. The heating element current waveform (uppermost waveform in FIG. 6) is a combination of the waveform of the electric current which flows through the heating element 203 and that which flows through the heating element 204.

(Pattern of Electric Power Control)

Figure 7:
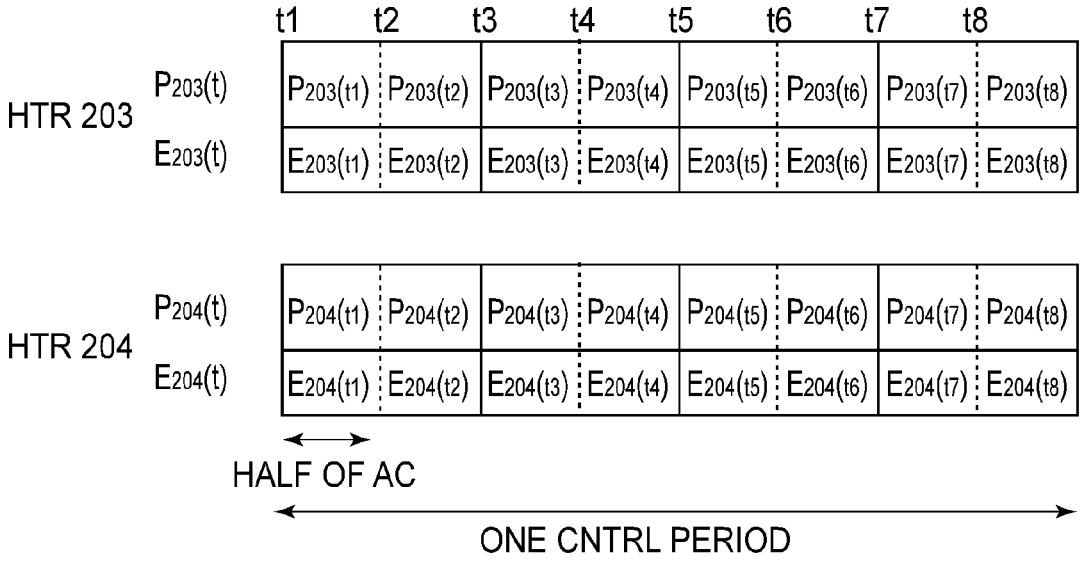
FIG. 7 is a table showing the pattern in which electric power is supplied to the heating elements in the first embodiment.

Next, referring to FIGS. 7 and 20, the pattern in which the amount by which electric power is supplied to the heating elements 203 and 204 is regulated by hybrid control is described. FIG. 7 shows the control pattern in which each control cycle corresponds to eight halves (four cycles) of the waveform of the commercial AC power. Incidentally, a "single control cycle" means the length of time between adjacent two points in time at which the electric power to be supplied to the heating elements 203 and 204 is adjusted in response to the temperature level detected by the temperature detection element 222. It is made up of continuous multiple halves of the oscillatory cycle of the AC power source. An electric power level Pin means the ratio of the "sum of the amount by which electric power is to be supplied to the first heating element 203 in response to the temperature of the fixation station, and the amount by which electric power is to be supplied to the second heating element 204 in response to the temperature of the fixation station", relative to the "sum of the largest amount by which electric power can be supplied to the combination of the first and second heating elements 203 and 204".

FIG. 20 is a table which shows two electric power levels Pin (%). An electric power control section selects one of the two electric power levels in response to the temperature (which in this embodiment is temperature level detected by temperature detection element 222) of the fixation station. There are provided 41 preset electric power levels (0/40-40/40), which are described later. In a case where the first heating element 203 needs to be supplied with electric power, the first electric power table, which is for the first heating element 203, is used. In a case where the second heating element 204 needs to be supplied with electric power, the second electric power table, which is for the second heating element 204, is used. The first and second tables are different from each other in the pattern in which the ratios by which electric power is to be supplied to the heating element are arranged. FIG. 7 shows the control pattern, based on which the actual first control pattern, that is, the actual control pattern for the first heating element 203, and the actual second control pattern, that is, the actual control pattern for the second heating element 204, shown FIG. 20, are created.

A referential code P203(*t*) stands for the ratio of the amount by which electric power is to be supplied to the first heating element 203, relative to the maximum amount of electric power which can be supplied to the first heating element 203, in a length of time which corresponds to half the oscillatory cycle of the commercial AC power source (which is equivalent to 10 msec, if electric power source frequency is 50 Hz). A referential code E203(*t*) stands for the ratio of the amount by which electric power is to be supplied to the first heating element 203, relative to the "maximum amount by which electric power can be supplied to the combination of the first and second heating elements 203 and 204".

Similarly, a referential code P204(*t*) stands for the ratio of the amount by which electric power is to be supplied to the second heating element 204, relative to the maximum amount by which electric power can be supplied to the second heating element 204, per half the cycle. A referential code E204(*t*) stands for the ratio of the amount by which electric power is to be supplied to the second heating element 204, relative to the "maximum amount by which electrical power can be supplied to the combination of the first and second heating elements 203 and 204", per half the cycle.

Referential codes t1-t8 stand for points in time. For example, E203(*t*1) and E204(*t*1) stand for the ratios of the amount by which electric power is to be supplied to the heating elements 203 and 204, respectively, relative to the maximum amount by which electric power can be supplied to the combination of the heating elements 203 and 204, at the same point (t1) in time (at the same point in phase).

In this embodiment, each cell (half cycle period) of two rows P203(*t*) and P204(*t*) of the table in FIG. 7 contains a value (%), which is in a range of 0(%)-100(%), counting in a unit (intervals) of 2.5%. The two heating elements are independently driven by the above-described heater driving circuit, in the control pattern given in FIG. 7. For example, in a case where P203(*t*1) is 50%, the FSRD1 is sent out with such a timing that electric power is supplied to the heating element 203 by an amount equal to 50% of the maximum amount of electric power which can be supplied to the heating element 203, during half the oscillatory cycle, between points t1 and t2 in time. In a case where P204(*t*1) is 30%, the FSRD2 is sent out with such a timing that electric power is supplied to the heating element 204 by an amount equal to 30% of the maximum amount by which electric power can be supplied to the heating element 204, at the same time as P203(*t*1). Thus, the heater 224 is supplied with electric power by Pin (%) which is the sum of the amount (%) by which electric power is to be supplied to the heating element 203 and the amount (%) by which electric power is to be supplied to the heating element 204. This control pattern (which is in electric power table in FIG. 20) is stored in advance in the above described engine controller 220 shown in FIG. 2, so that an electric power level can be selected according to the amount by which heater 224 needs to be supplied with electric power. The electric power table is designed so that within each control cycle, the positive and negative sides become symmetrical in terms of the phase of the waveform of the AC power source. That is, the negative and positive sides are symmetrical in terms of electric current waveform, within each control cycle.

The row E203(*t*) and E204(*t*) of the table in FIG. 7 show the ratios of the amount by which electric power is to be supplied to the heating element 203 and 204, respectively, when it is assumed that the largest amount by which electric power can be supplied to the combination of the heating elements 203 and 204 is 100. The values of E203(*t*) and E204(*t*) can be obtained by the following mathematical equations (1) and (2), in which R203 and R204 stand for the amounts of electrical resistance of the heating elements 203 and 204, respectively.

$$E_{203}(t) = \frac{R_{204}}{R_{203} + R_{204}} \times P_{203}(t) \quad (1)$$

$$E_{204}(t) = \frac{R_{203}}{R_{203} + R_{204}} \times P_{204}(t) \quad (2)$$

(Method for Creating Control Pattern (Electric Power Supply Table))

At this time, a method for creating the pattern in which the amount by which electric power is to be supplied to the heater 224 in a case where the heater 224 is configured in its heating element arrangement as shown in FIG. 3(*b*), is described. Generally speaking, "nonuniform fixation" occurs because a sheet of recording medium is unevenly heated. The reason why a sheet of recording medium is unevenly heated is that the amount by which electric power is supplied to a heating element (which is equivalent to amount of heat applied to sheet of recording medium) is unstable. Therefore, what is desirable to minimize a fixing device in nonuniform fixation is to minimize the fluctuation in the amount by which electric power is supplied to a heater (heating element). In other words, what is desirable to minimize a fixing device in nonuniform fixation is to stabilize the amount by which electric power is supplied to a heating element per control cycle. However, in a case where the length of time it takes for a given point of a sheet of sheet of recording medium to travel between adjacent two heating elements is close to the cycle (length of time) with which the heating elements are turned on or off, the total amount of heat which the given point of sheet of recording medium receives from the multiple heating elements becomes different from the total amount of heat which the other point of the sheet of recording medium receives, which results in nonuniform fixation. For example, in a case where a given point of a sheet of recording medium travels between adjacent two heating elements within a length of time which corresponds to half the waveform (half cycle) the AC power source, within each control cycle, if the heating elements are turned on or off for every half the waveform, some points of the sheet of recording medium pass by the heating elements only when the heating elements are on, being therefore given heat by the heating elements by the maximum amount of heat available from the heating element at a given moment. In comparison, the other points of the sheet of recording medium pass by the heating elements only when the heating elements are off, being thereby not given heat by the heating elements by the maximum amount. That is, while some points of the sheet of recording medium are given the full amount of heat available from the heating elements, the other points of sheet of recording medium may be given a far less amount of heat or virtually no heat. Consequently, the sheet of recording medium is unevenly heated. This phenomenon of uneven heating of a sheet of recording medium is likely to occur in a case where the heat transmission from a heating element to the sheet of recording medium is excellent. In comparison, in a case where the heat transmission is inefficient, the heat from the adjacent heating elements come together, and therefore, transfers to the sheet of recording medium more or less evenly across the sheet. Therefore, the nonuniform uneven fixation is less likely to occur. In other words, what is desirable to minimize a fixing device in nonuniform fixation is to provide a fixing device with multiple heating elements (two in this embodiment), and supply the multiple (two) heating elements with electric power in such a manner that the total amount of heat (which is equivalent to total amount of electric power to be supplied to heating elements) to be given to a given point of a sheet of recording medium by the combination of the first and second becomes equal to total amount of heat to be given to the other points of the sheet. With the heating elements being supplied with electric power in this manner, virtually all points of the sheet of recording medium become roughly equal in the total amount by which they receive heat from the combination of the two heating elements, and therefore, the fixing device is minimized in nonuniform fixation. The following Formula (3) shows the relationship which has to be satisfied between the combination of E203(*t*) and E204(*t*), and Pin5, in order to minimize the nonuniform fixation, according to the present invention $$E_{203}(t) + E_{204}\left(t + \frac{A}{V1}\right) \cong Pin \quad (3)$$

The left side of Formula (3) is the sum of the ratio (%) of the amount by which electric power is to be supplied to the heating element 203 at a give point t in time, and the ratio (%) of the amount by which electric power is to be supplied to the heating element 204, (A/V1) after the given point t in time. In the formula (3), "A" in Formula (3) stands for the distance between the heating elements 203 and 204, "V1" stands for the recording medium conveyance speed in the fixation nip. That is, "E203(*t*)" is the ratio of the amount by which electric power is to be supplied to the heating element 203 with the first timing (point t in time) per control cycle. "E204(*t*)" is the ratio of the amount by which electric power is to be supplied to the heating element 204 with the second timing (point (t+A/V1) in time) per control cycle. The right side of Formula (3) is the sum of E203(*t*) and E204 (*t*+A/V1). On the other hand, as described above, the right side indicates the ratio of the target total amount by which electric power is to be supplied to the combination of the two heating elements 203 and 204, relative to the total amount by which electric power can be supplied to the combination of the heating elements 203 and 204, per control cycle. That is, it is the ratio that is to be changed (switched) according to the temperature detected by the thermistor 222 during a printing operation. Incidentally, "≈" means "approximately equal". A given point Y of a sheet of recording medium travels between the first and second heating elements in the length (A/V1) of time. The point Y of the sheet of recording medium is heated at a point t1 in time, by the heat from the first heating element, the amount of which is equivalent to E203(*t*), and then, is heated at a point (t+A/V1) in time, by the heat from the second heating element, the amount of which is equivalent to E204(*t*+A/V1). Therefore, if the length (A/V1) of time is equivalent to half the oscillatory cycle of the AC power source, what is desirable to minimize the fixing device 224 in nonuniform fixation is to create the electric power table (control pattern) so that the sum of E203(*t*1) and E204(*t*2) becomes roughly equal to the electric power level Pin. In such a case, the table is desired to be created so that the sum of the E203(*t*2) and E204(*t*3) becomes roughly equal to Pin, and the sum of E203(*t*3) and E204(*t*4) also becomes roughly equal to Pin. This is also true with other points in phase angle.

In this embodiment, P203(*t*) and P204(*t*) were set to satisfy Formulas (1)-(3) when the recording conveyance speed V1 is 200 mm/sec; the distance A between the heating elements 203 and 204 is 2 mm; R203 is 17Ω; R204 is 27Ω; and the AC power source frequency is 50 Hz. The P203(*t*) and P204(*t*) are to be set with 2.5% interval, and the negative and positive currents are made symmetrical in waveform. Therefore, what is desirable is set the control pattern so that the value of the left side of the equation (3) become as close as possible to the value of Pin (which is electric power ratio selected in response to detected temperature), while taking the effects of the high frequency current and/or flickering; it is unnecessary for the value of the left side of Equation (3) to become exactly equal to the value of Pin.

Figures 8, 9:
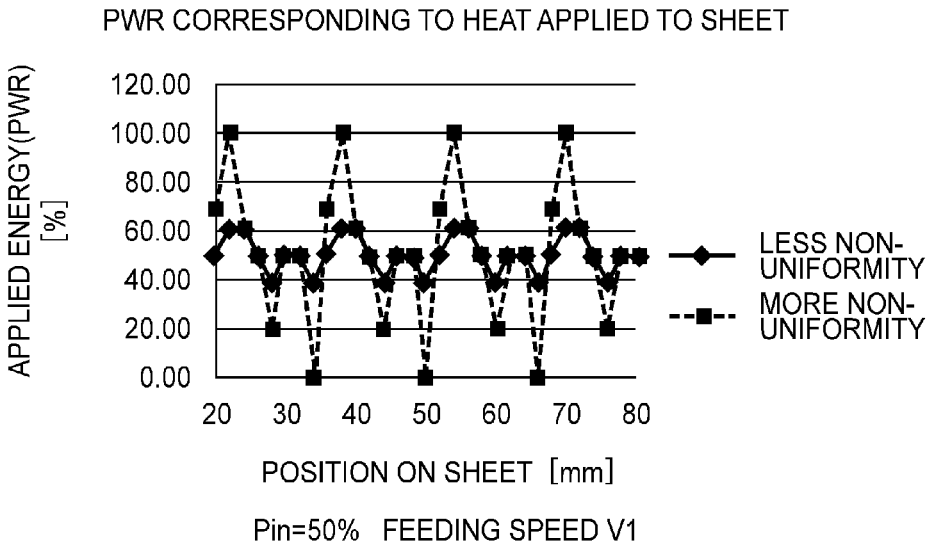
FIG. 8 is a table showing an example of the actual pattern in which electric power is supplied to the heating elements in the first embodiment.
FIG. 9 is a graph which shows the relationship between a given point of a sheet of recording medium in terms of the recording medium conveyance direction, and the amount of electric power (which is equivalent to the amount of heat given to the given point of the sheet of recording medium) applied to the heating elements while the given point of the sheet of recording medium was conveyed through the fixing nip.

FIG. 8 is a table which shows the actual control pattern set to minimize the nonuniform fixation under the above described operational condition (Pin=50%). In this embodiment, the control pattern for the heating element 203 is set first, and then, the control pattern for the heating element 204 is set to satisfy Formula (3). FIG. 8(*a*) shows an example of control pattern which is to be used when the recording medium conveyance speed is V1. In this case, the length of time it takes for the point Y of a sheet of recording medium to travel between the heating elements 203 and 204 is 10 msec. Since the length of time which is equivalent to half the waveform (half cycle) of the commercial AC power source which is 50 Hz in frequency is 10 msec, the value of the left side of Formula (3) is obtained by substituting the value of the following Formula (4) for (t+A/V1) in Formula (3):

$$t_n + \frac{A}{V1} = t_{n+1} \ (n \text{ is an integer}) \quad (4)$$

in which n is an integer.

Even if the length of time it takes for the point Y to travel the distance A between the two heating elements 203 and 204 at the recording conveyance speed V1 is different from the length of time equivalent to half the cycle (waveform) of the AC power source, Formula (4) was used for the calculation as long as the difference is within the rated wave number of the AC power source.

For example, P203(*t*1) is 50%. Therefore, the ratio at which heat is generated by the heating element 203 (amount by which electric power is to be supplied to heating element 203) is 30.8%, which is obtained from Equation (1). The ratio at which electric power is to be supplied to the heating element 204 at point t2 in time, that is, A/V1 seconds after electric power begins to be supplied to the heating element 203, is only 19.32% (=50%-30.68%) which is obtained from Formula (3). By converting these figures, P204(*t*2) is set to 50%, which is the smallest in the amount of error, with 2.5% interval. That is, referring to FIG. 8, when Pin is 50%, E203(*t*1) and E204(*t*2) are set to 30.68% and 19.32%, respectively. Thus, E203(*t*1)+E204(*t*2)=50%. That is, the sum of the ratio at which electric power is to be supplied to the heating element 203 at a point t1 in time, and the ratio at which electric power is to be supplied to the heating element 204 at a point t2 in time, is equal to Pin (50%) which is the electric power level selected in response to the detected temperature.

Looking at other points in time, which correspond to other points in the oscillatory phase of the AC power source, E203 (*t*3)+E204(*t*4), and E203(*t*6)+E204(*t*7) are both 50%. whereas the E203(*t*2)+E204(*t*3), and E203(*t*7)+E204(*t*8) are both 38.6(%). Further, E203(*t*4)+E204(*t*5) and E203(*t*5)+E204(*t*6) are both 61.36(%). In other words, at some points in oscillatory phase of the AC power source, the sum is different from 50%. However, the difference is no more than 20 points. As long as the difference is at this level, nonuniform fixation can be kept at or below the discernable level.

This embodiment was described with reference to the case in which Pin was 50%. However, even if Pin is not 50% as shown in FIG. 20, all that has to done to keep the nonuniform fixation below the discernible level is for the power table to be set as it is when Pin is 50%, so that the difference falls within 20 points. For example, if Pin is 70%, the first and second electric power tables have only to be set in terms of the oscillatory phase of the AC power source so that the E203(*t*)+E204(*t*+A/V1) becomes 70%.

What is desirable to minimize the nonuniform fixation is to ensure that Formula (3) is satisfied at no less than 70% of time per control cycle. Further, when Pin is in a range of 30%-80%, the waveform of the electric power supplied to the heater 224 is fixation. Therefore, the tables, which is to be set to satisfy Formula (3), is desired to be set also to satisfy: 30%≤Pin≤80%.

Further, in a case where an image forming apparatus (fixing device) is enabled to convey a sheet of recording medium not only at the speed V1, but also, at speed V2, what is desirable is to control the power supply so that Formula (3) is satisfied when the sheet is conveyed at one of the two speeds, for example V1 (when speed is V2, V1 in Formula (3) is to be substituted by V2).

In this embodiment, P203(*t*1)-P204(*t*8) were obtained based on the control pattern (first control pattern) for the heating element 203, as described above. Needless to say, it may be set up so that the control pattern for the heating element 204 is first set, and then, the control pattern for the heating element 203 is set based on the control pattern for the heating element 204.

Next, referring to FIG. 9, the effects of this embodiment upon the reduction of nonuniform fixation is described. The graph in FIG. 9 shows the amount (%) by which electric power was supplied to the heater, that is, the amount of heat given to various points of a sheet of recording medium, when various points of a sheet of recording medium are conveyed past the heater, when the recording medium conveyance speed was V1. The axis of ordinates stands for the amount (which is expressed in relative value (%)) by which electric power was supplied to the heater, which is equivalent to the "sum of the amount of heat given to a given point of a sheet of recording medium by one of the two heating elements, and the amount of heat given to the same point of the sheet of recording medium by the other heating element". The axis of abscissas stands for the distance (position) of various points of the sheet of recording medium from the leading edge of the sheet, in terms of the recording medium conveyance direction. The dotted line represents the case in which the electric power was controlled in a control pattern set without taking Formula (3) into consideration. The solid line represents the case in which the electric power was controlled in the control pattern shown in FIG. 8, that is, the pattern set in consideration of Formula (3). In this case, the amount of electric power is expressed in terms of the ratio relative to the amount by which electric power was given to the heater. In the case of the control pattern indicated by the dotted line, the difference between the largest amount by which electric power was supplied to the heater when a give point (area) of the sheet of recording medium was moved past the heater, and the smallest amount by which electric power was supplied to the heater when the given point (area) of the sheet was moved past the heater, is rather large. In comparison, in the case of the control pattern represented by the solid line, the difference is relatively small. As is evident from the distribution of the amount by which electric power was applied, across the sheet S, which is shown in FIG. 9, controlling the amount by which electric power is supplied to the heater, with the use of the electric power table in this embodiment is effective to minimize nonuniform fixation.

Figure 10:
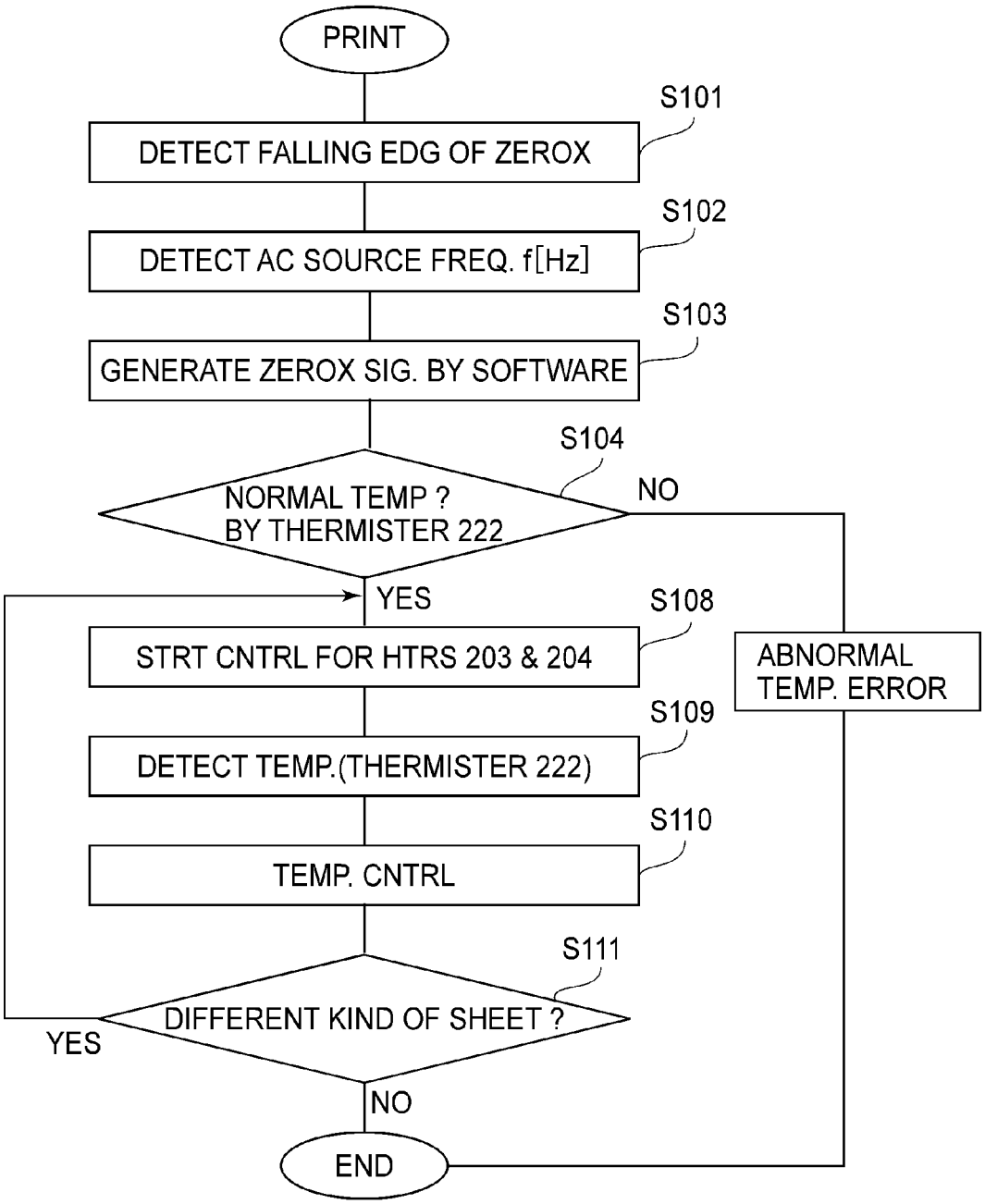
FIG. 10 is a flowchart of the sequence through which the power supply to the fixing device is controlled in the first embodiment.

Next, referring to FIG. 10, the sequence used in this embodiment to control the amount by which electric power was supplied to the heater is described. FIG. 10 is a flowchart of the control sequence in this embodiment. As the engine controller 220 receives a print start command, it detects the trailing edge of the zero crossing point detection signal of the AC power source, in S101. Then, it calculates the frequency of the AC power, from the frequency of the trailing edge, in S102. Then, it generates the control zero crossing point detection signal described with reference to FIG. 5, in S103. If the heater temperature detected by the thermistor 222 is not abnormal in S104, it begins to control the amount by which electric power is to be supplied to the heating elements 203 and 204, setting the point T in time at which the heater 224 begins to be controlled in temperature, to zero (T=0) in S108. Thereafter, the heater 224 is continuously controlled in temperature so that its temperature remains at a preset level, while the heater temperature is being monitored by the thermistor 222, in S109 and S110. If it becomes necessary for the recording medium conveyance speed to be changed because of the change in the recording medium (type, size, etc.) or the like, in S111, the engine controller 220 searches through the control pattern tables, and uses a control pattern which is suitable for the new recording medium. For example, if recording medium is thick paper, such control as reducing the recording medium conveyance speed to insure that the recording medium is given a sufficient amount of heat is sometimes carried out. Further, an image forming apparatus is sometimes changed in recording medium conveyance speed according to recording medium size. For example, in a case where recording medium is small in size, a portion of a structural component, which corresponds in position to the portion of the recording medium passage, which is outside the recording medium path, is relatively large. Therefore, if a printing operation which uses a substantial number of small sheets of recording medium is continued without intermissions, the structural components of a fixing device, the position of which corresponds to the portion of the recording medium passage, which is outside the recording medium path, become excessively high in temperature, which sometimes damages the fixing device (image forming apparatus). In such a case, therefore, a control for reducing the image forming apparatus (fixing device) in recording medium conveyance speed is sometimes carried out.

As described above, if a control pattern which satisfies Formula (3) is set in advance, and the heating elements are controlled based the control pattern which satisfies Formula (3), the fixing device 224 is minimized in the nonuniformity in which it applies heat to a sheet of recording medium.

Embodiment 2

Next, the second embodiment of the present invention is described. The image forming apparatus in this embodiment is the same in structure as the image forming apparatus in the first embodiment. Only difference in structure between the image forming apparatus in the second embodiment and that in the first embodiment is that the one in the second embodiment can be set in recording medium speed to V1 and V2. In the first embodiment described above, even if the image forming apparatus is provided with multiple recording medium conveyance speeds, the amount by which electric power is supplied to its heater is controlled with the use of only a single control pattern (electric power table). For example, in a case where the difference among the multiple recording medium conveyance speeds is minute, images which are uniform in density can be outputted with the use of only a single control pattern. In other word, the first embodiment is suitable for such a case. In comparison, in the second embodiment, the fact that the image forming apparatus can be operated at any of multiple recording medium speeds is taken into consideration, and multiple control patterns which are suitable for the multiple recording medium conveyance speeds, one for one, are prepared in advance, so that if the image forming apparatus is changed in its recording medium conveyance speed, the control pattern also can be changed to be matched to the new recording medium conveyance speed.

The mathematical formula in this embodiment, which is related to the recording medium conveyance speed V1, is the same as Formula (3). When the recording medium conveyance speed is set to V2, P203(*t*) and P204(*t*) have only to be set so that the following Formula (5) is satisfied:

$$E_{203}(t) + E_{204}\left(t + \frac{A}{V2}\right) \cong Pin \tag{5}$$

In this embodiment, the first and second electric power tables for the recording medium conveyance speeds V1 and V2, which can satisfy Formula (3), when the recording medium conveyance speeds V1 and V2 are 200 mm/sec and 100 mm/sec, respectively; the distance A is 2 mm; R203 and R204 are 17Ω and 27Ω, respectively; and the frequency of the AC power source is 50 Hz, are created. FIG. 21 shows examples of such tables.

FIG. 11 is a table which shows the actual control patterns set according to the above-described conditions to minimize the nonuniform fixation (electric power level Pin=50%). In this embodiment, it is the control pattern for the heating element 203 that was set first. Then, the control pattern for the heating element 204 was obtained by the calculation made to satisfy Formulas (3) and (5). FIG. 11(*a*) shows an example of actual control pattern which was used when the recording conveyance speed was V1. This control pattern is the same as the one in the first embodiment, and therefore, is not described here. FIG. 11(*b*) shows the actual control pattern used when the recording medium conveyance speed was V2. Under the above described condition, the length of time it takes for the point Y of the sheet of recording medium to travel between the heating elements 203 and 204 is 20 msec. The amount (in percentage) by which electric power is to be supplied to the heating element 204 was calculated by applying Equation (6) to Equation (5).

$$t_n + \frac{A}{V2} = t_{n+1} \quad (n \text{ is an integer}) \tag{6}$$

For example, in the case of the control table shown in FIG. 11(*b*), P203(*t*1) is 50%. Thus, E203(*t*1), which is the ratio of the amount by which heat is to be generated by the heating element 203 (ratio of amount by which electric power is to be supplied to heating element 203) is 30.68% according to Formula (I). Thus, the ratio of the amount by which electric power is to be supplied to the heating element 204 at a point t2 in time, that is, A/V2 second after electric power begins to be supplied to the heating element 203, is 19.32% according to Formula (5). Converting these figures, P204(*t*3) was set to 50%, which is the smallest in the amount of error, with 2.5% interval. This is how P204(*t*1)-P204(*t*8) were obtained based on the control pattern for the heating element 203. Needless to say, it may be the control pattern for the heating element 204 that is set first. In such a case, the control pattern for the heating element 203 is to be derived by calculation based on the control pattern for the heating element 204.

Figure 12:
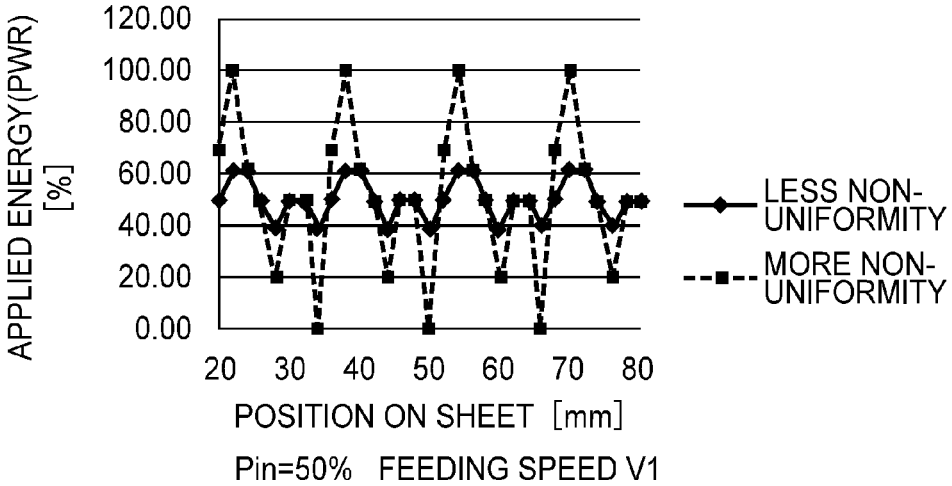
FIGS. 12(*a*) and 12(*b*) are graphs which show the relationship between a given point of a sheet of recording medium in terms of the recording medium conveyance direction, and the amount of electric power (which is equivalent to the amount of heat given to the given point of the sheet of recording medium) supplied to the first and second heating elements while the given point was conveyed through the fixation nip in the second embodiment.
Figure 12:
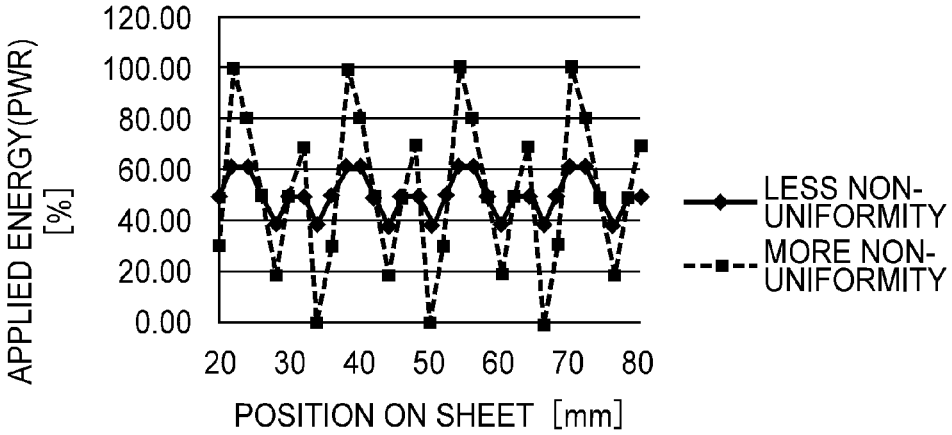

Next, referring to FIGS. 12(*a*) and 12(*b*), the effects of this embodiment upon the reduction of nonuniform fixation is described. The graph in FIG. 12(*a*) shows the relationship between the amount by which electric power was supplied to the heater while a given point of a sheet of recording medium moved past the heater when the recording medium conveyance speed was V1, and the amount of heat which the given point of the sheet received when it moved past the heater. The graph in FIG. 12(*b*) shows the same relationship as the one shown in FIG. 12(*a*), except that in the case of the graph in FIG. 12(*b*), the recording medium conveyance speed was V2. What the axis of ordinates and the axis of abscissa of the graphs represent are the same as those of the graphs in FIG. 9. The dotted line represents the case in which the electric power was controlled in a pattern set without taking Formulas (3) and (5) into consideration. The solid line represents the case in which the electric power was controlled in the pattern shown in FIG. 11, that is, the pattern set in consideration of Formulas (3) and (5). In this case, the amount by which electric power was supplied is expressed in terms of the ratio relative to the amount by which electric power was supplied in the case which is represented by the dotted line. In the case of the control pattern indicated by the dotted line, the difference between the largest amount by which electric power was supplied to the heater when a give area of the sheet of recording medium was moved past the heater, and the smallest amount by which electric power was supplied to the heater when the given area of the sheet was moved past the heater, is rather large. In comparison, in the case of the control pattern represented by the solid line, the difference is relatively small. As is evident from the distribution of the amount by which electric power was applied, across the sheet S, which is shown in FIG. 12, controlling the amount by which electric power is supplied to the heater, with the use of the electric power table in this embodiment, is effective to minimize nonuniform fixation, even in the case of an image forming apparatus provided with multiple recording medium conveyance speeds.

Figure 13:
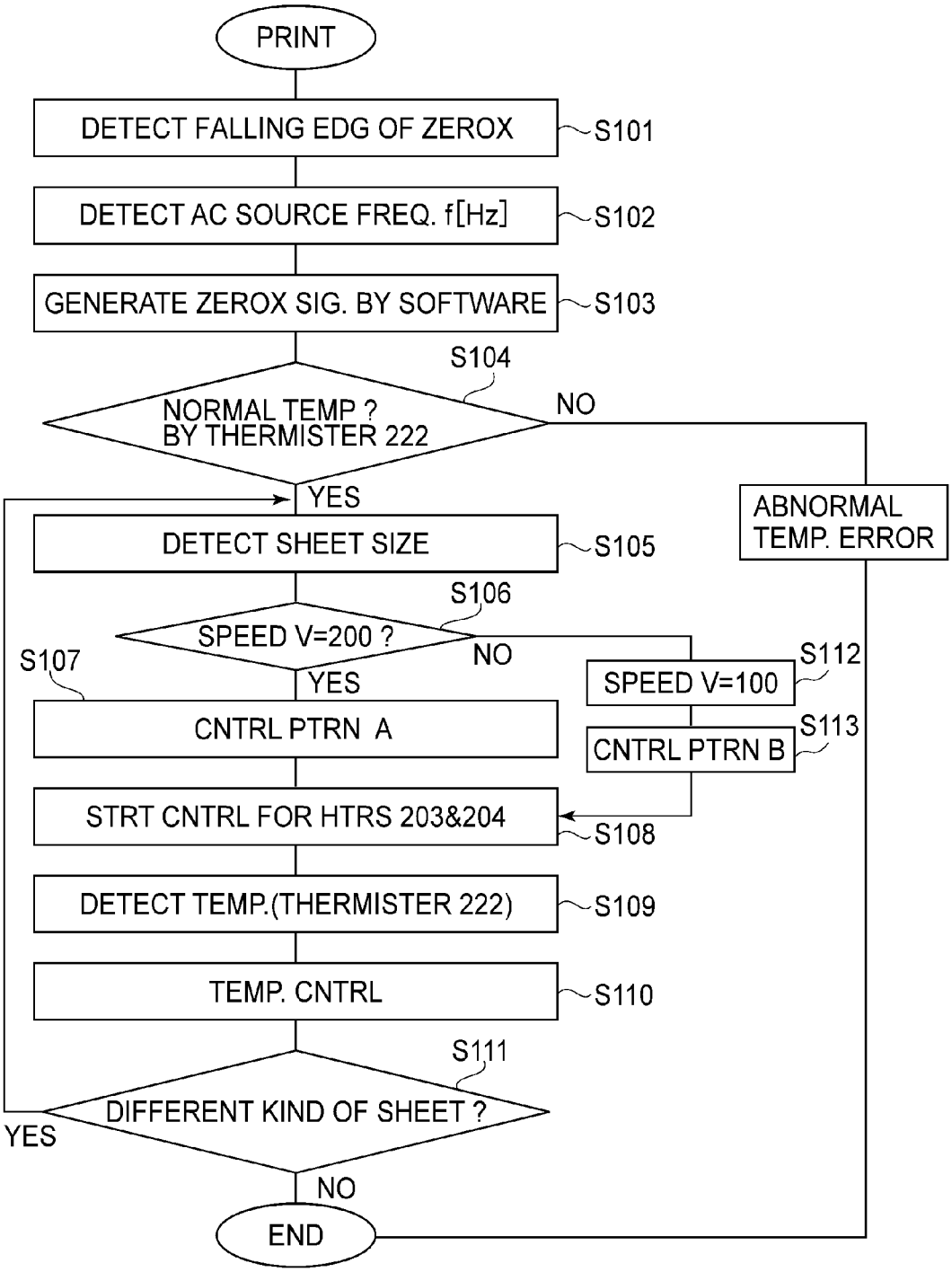
FIG. 13 is a flowchart of the sequence through which the power supply to the fixing device is controlled in the second embodiment.

Next, referring to FIG. 13, the control sequence used in this embodiment to control the amount by which electric power was supplied to the heater is described. FIG. 13 is a flowchart of the electric power supply control sequence in this embodiment. The portion of the control sequence from when the engine controller 220 receives a print start command to S104 is the same as the first embodiment (FIG. 10). Then, in S105, the engine control 220 detects the recording medium size, etc., and sets the recording medium speed based on the properties, such as size, of the recording medium in S106 and S112. Then, in S107 and S113, it searches for the control pattern table, which has been stored in advance in its memory and is suitable for the set recording medium conveyance speed. Thereafter, it begins to control the heating element 203 and 204 in terms of the amount by which the heating elements 203 and 204 are to be supplied with electric power, and when electric power is to be supplied to the heating elements 203 and 204, with the point T in time at which the heat is to begin to be controlled in temperature, set to zero (T=0). Thereafter, the control sequence is the same as the one in the first embodiment (FIG. 10), and therefore, is not described here.

As is evident from the description of the second embodiment given above, even in the case of an image forming apparatus provided with two recording medium conveyance speeds, as long as the heating elements of the fixing device of the apparatus are controlled in the amount by which electric power is supplied thereto, in the pattern set in advance to satisfy both Formulas (3) and (5), according to each of the two recording medium conveyance speeds, the apparatus (fixing device) can be minimized in the nonuniform heat distribution across a sheet of recording medium. This embodiment was described with reference to the image forming apparatus provided with two recording medium conveyance speeds. However, it is not intended to limit the present invention in terms of the number of recording medium speeds with which an image forming apparatus is provided. That is, the present invention is also applicable to an image forming apparatus provided with two or more recording medium conveyance speed, as long as multiple control patterns which are suitable for the multiple recording conveyance speeds, one for one, are prepared, and the apparatus is switched in control pattern according to the selected recording medium conveyance speed. The effects of the application of the present invention to such an image forming apparatus are the same as those described above.

Embodiment 3

The structure of the image forming apparatus in this embodiment is roughly the same as that in the first embodiment described above, except that the heater of the fixing device of the apparatus in this embodiment is provided with three heating elements configured as shown in FIG. 3(*c*). Here, therefore, the control pattern in this embodiment, which is for controlling a heater such as the one in this embodiment, which has three heating elements is described. The three heating elements are individually driven by three triacs, one for one. The apparatus is structured so that as a sheet of recording medium is conveyed through its fixing device, a given point Y of the sheet sequentially passes by the heating elements 203, 204, and 205 in the listed order. Thus, the ratio by which electric power is supplied to each of the three heating elements 203, 204, and 205 can be calculated with the use of Formulas (7)-(9), respectively.

$$E_{203}(t) = \frac{R_{204} \cdot R_{205}}{R_{203} \cdot R_{204} + R_{204} \cdot R_{205} + R_{205} \cdot R_{203}} \times P_{203}(t) \tag{7}$$

$$E_{204}(t) = \frac{R_{203} \cdot R_{205}}{R_{203} \cdot R_{204} + R_{204} \cdot R_{205} + R_{205} \cdot R_{203}} \times P_{204}(t) \tag{8}$$

$$E_{205}(t) = \frac{R_{203} \cdot R_{204}}{R_{203} \cdot R_{204} + R_{204} \cdot R_{205} + R_{205} \cdot R_{203}} \times P_{205}(t) \tag{9}$$

In order to minimize the nonuniform fixation, the sum of the ratios by which electric power is supplied to the heating elements 203, 204 and 205 satisfies the following Formula (10).

$$E_{203}(t) + E_{204}\left(t + \frac{A}{V1}\right) + E_{205}\left(t + \frac{A+B}{V1}\right) \cong Pin \tag{10}$$

It is assumed here that a sheet of recording medium is conveyed at a preset recording conveyance speed V1, and also that the given point Y of the sheet is given heat by the heating element 203 at points t in time; is given heat by the heating element 204, (A/V1) after the point t in time; and is given heat by the heating element 205, (B/V1) after when the point Y begins to be given heat by the heating element 204. "B" in Formula (10) stands for the distance between the heating elements 204 and 205. The left side of Formula (10) is the sum of the ratios by which electric power is supplied to the heating elements 203, 204, and 205, respectively. As for the right side of Formula (10), it is the ratio of the total amount by which electric power is supplied to the combination of the heating elements 203, 204 and 205, as it is in the first embodiment. That is, it is the ratio of the total amount of electricity, which is to be switched according to the temperature level detected by the thermistor 222 during a printing operation. Like in the second embodiment, if the image forming apparatus is provided with two recording medium conveyance speed V1 and V2, the electric power supply tables are to be set with the use of Formulas (10) and (11).

$$E_{203}(t) + E_{204}\left(t + \frac{A}{V2}\right) + E_{205}\left(t + \frac{A+B}{V2}\right) \cong Pin \tag{11}$$

In this embodiment, the recording medium speed V1 was 200 mm/sec. The distance A between the heating elements 203 and 204 was 2 mm, and the distance B between the heating elements 204 and 205 was also 2 mm. R203, R204, and R205 were 30Ω, 20Ω and 10Ω, respectively. The AC power source frequency was 50 Hz. P203(*t*), P204(*t*), and P205(*t*) were set to satisfy Formula (10) under the above described conditions. Further, P203(*t*), P204(*t*) and P205(*t*) were also set to satisfy Formula (10) under the above described conditions, except that the recording medium conveyance speed was V2, which was 100 mm/sec. In other words, two control patterns (electric power tables) were independently set according to the two recording medium conveyance speeds V1 and V2, one for one. P203(*t*), P204(*t*) and P205(*t*) were set with 2.5% interval, and also that the electric current flowed through all heating elements become symmetrical in waveform in terms of the negative and positive sides. Therefore, it is possible that the left side of Formula (10) and the left side of Formula (II) do not become equal to Pin. Even in such a case, what is desirable to set the control pattern so that the difference between the left side of Formula (10) and Pin, and that between the left side of Formula (II) and Pin, are minimized. Further, the control patterns are to be set so that the differences are minimized, while taking into consideration the effects of the minimization upon the generation of the high frequency wave and/or flickering.

FIG. 14 is a table which shows the actual control pattern set to minimize the nonuniform fixation, under the above described operational condition (Pin=50%). In this embodiment, the control patterns for the heating elements 203 and 204, one for one, are set first, and then, the control pattern for the heating element 205 was set to satisfy Formulas (10) and (11). FIG. 14(*a*) shows an example of control pattern which was used when the recording medium conveyance speed was V1. In this case, the length of time it takes for the point Y of a sheet of recording medium to travel between the heating elements 203 and 204 is 10 msec. Since the length of time which is equivalent to half the waveform (half cycle) of the commercial AC power source, which is 50 Hz in frequency, is 10 msec, the value of the left side of Formula (12) was obtained by substituting the value of the following Formula (12), for (t+A/V1) in Formula (10):

$$t_n + \frac{A}{V1} = t_{n+1},\ t_n + \frac{A+B}{V1} = t_{n+2}\ (n \text{ is an integer}) \tag{12}$$

That is, the control patterns were set so that the following Formula was satisfied:

$$E_{203}(t_n)+E_{204}(t_{n+1})+E_{205}(t_{n+2}) \cong \mathrm{Pin}$$

Even in a case where the length of time it took for a given point Y of a sheet of recording medium to travel across the distance A between the heating elements 203 and 204 was different from the length of time which is equivalent to half the waveform of the AC power source, Formula (10) was used for the calculation. For example, P203(*t*1) and P204(*t*2) were 50% and 0%, respectively. The values of E203(*t*1) and E204(*t*2) obtained using Formulas (7) and (8) were 9.09% and 0%, respectively. Thus, the ratio by which electric power begins to be supplied to the heating element 205 at a point t3 in time, that is, B/V1 seconds after the point t1 in time, was 40.91% from Formula (10). Converting this figure, P205(*t*3) was 70%, which was the smallest in error, with 2.5% interval. As described above, P204(*t*1)-P204(*t*8), and P205(*t*1)-P205(*t*8), were obtained based on the control pattern for the heating element 203. Needless to say, it may be for any of the three heating elements that a control pattern is first set.

FIG. 14(*b*) shows an example of the actual control pattern used when the recording medium conveyance speed was V2. The length of time it takes for the point Y of the sheet of recording medium to travel between the heating elements 203 and 204 under the above described condition is 20 msec. Thus, the following Formula (13) was applied to Formula (II) to set the control patterns for the heating elements 204 and 205.

$$t_n + \frac{A}{V2} = t_{n+2},\ t_n + \frac{A+B}{V2} = t_{n+4} \tag{13}$$

($n$ is an integer

That is, the control patterns for the heating elements 204 and 205 were set to satisfy the following Formula:

$$E_{203}(t_n)+E_{204}(t_{n+2})+E_{205}(t_{n+4})\cong \mathrm{Pin}$$

The method for setting the control pattern for the heating elements 204 and 205 by calculation is the same as the above described on, and therefor, is not described in detail.

Figure 15:
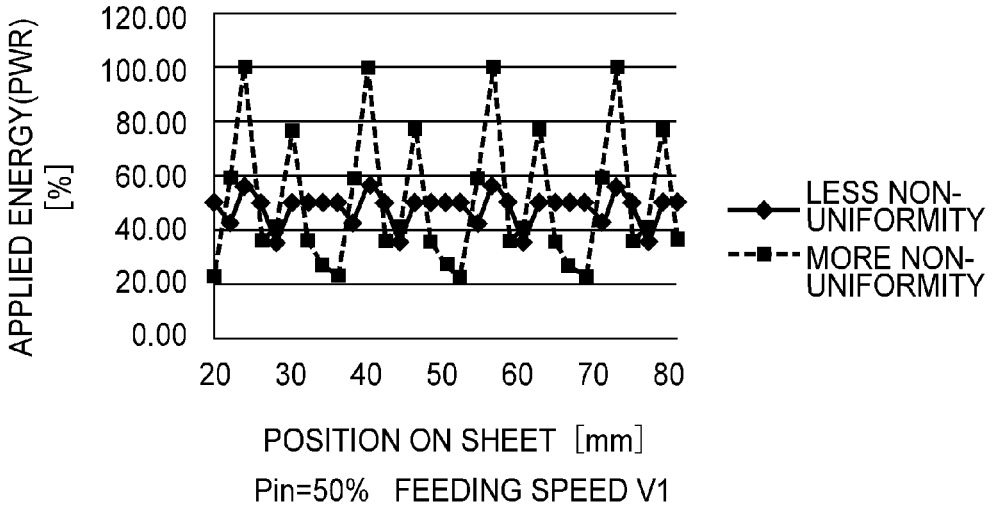
FIG. 15 is a graph which shows the relationship between a given point of a sheet of recording medium in terms of the recording medium conveyance direction, and the amount of electric power (which is equivalent to the amount of heat given to the given point of the sheet of recording medium) supplied to the heating elements while the given point was conveyed through the fixation nip in the third embodiment.
Figure 15:
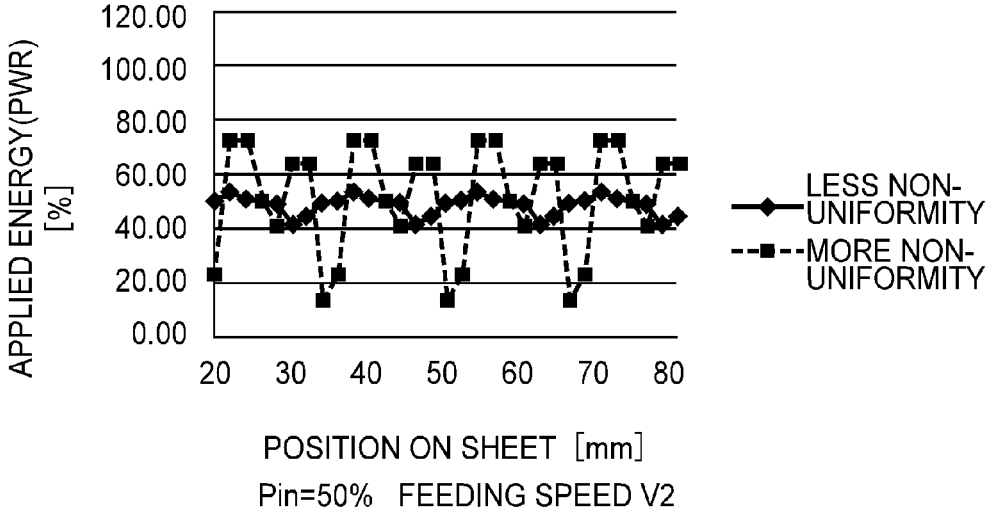

Next, referring to FIGS. 15(*a*) and 15(*b*), the effects of this embodiment upon the minimization of the nonuniform fixation is described. The graphs in FIGS. 15(*a*) and 15(*b*) show the amounts by which electric power was supplied to the heater while various points of a sheet of recording medium moved by the heater while the recording medium speeds were V1 and V2, respectively. The axis of ordinates stands for the total amount, expressed in relative value (%) by which electric power was supplied to the heater, which is equivalent to the "sum of the amount of heat given to a given point of the sheet of recording medium by the combination of three heating element". The dotted line represents the case in which the electric power was controlled in a control pattern set without taking Formulas (10) and (11) into consideration. The solid line represents the case in which the electric power was controlled in the control pattern shown in FIG. 14, that is, the pattern set in consideration of Formulas (10) and (11). In this case, the amount of electric power is expressed in terms of the ratio relative to the value of the dotted line. In the case of the control pattern indicated by the dotted line, the difference between the largest amount by which electric power was supplied to the heater when a give area of the sheet of recording medium was moved past the heater, and the smallest amount by which electric power was supplied to the heater when the given area of the sheet was moved past the heater, is rather large. In comparison, in the case of the control pattern represented by the solid line, the difference is relatively small. As is evident from the distribution of the amount by which electric power was applied across the sheet of recording medium, which is shown in FIG. 14, this embodiment is effective to minimize nonuniform fixation.

The flowchart of the control sequence in this embodiment is the same as the one shown in FIG. 13. That is, its description is the same as that of the flowchart in FIG. 13. Therefore, it is not described here.

As described above, even an image forming apparatus (fixing device) having three or more heating elements can output a print which is virtually free of nonuniform fixation, as long as each of the three or more heaters is controlled according to the control pattern set to satisfy Formulas (10) and (11).

Embodiment 4

The structure of the image forming apparatus in this embodiment is the same as that of the image forming apparatus in the first embodiment, except that the heater of the fixing device of the apparatus in this embodiment is provided with three heating elements which branch as shown in FIG. 3(*d*). More specifically, in this embodiment, the heating element 203, which is driven by a single triac, is bifurcated. That is, the heater in this embodiment is structured so that a given point Y of a sheet of recording medium is made to pass by the heating element 203 for the second time after it moves by the heating elements 203 and 204. Hereafter, the upstream portion of the heating element 203 in terms of the recoding medium conveyance direction, that is the portion of the heating element 203, which the point Y of the sheet passes by first, when the sheet is moved through the fixation nip is referred to as the upstream heating element 203, where as the portion of the heating element 203, which the point Y of the sheet passes by after it passes by the heating element 204, is referred to as the downstream heating element 203.

In order for the image forming apparatus (fixing device) structure as described, to be minimized in nonuniform fixation, the total amount by which electric power is supplied to the heater while a given point (Y) of a sheet of recording medium is conveyed through the fixation nip has to satisfy the following Formula (14).

$$\frac{E_{203}(t)}{2} + E_{204}\left(t + \frac{A}{V1}\right) + \frac{E_{203}\left(t + \frac{A+B}{V1}\right)}{2} \cong Pin \tag{14}$$

A sheet of recording medium is conveyed at a preset speed V1, and a given point Y of the sheet of recording medium is given heat by the upstream heating element 203 at a given point t in time. Then, the point Y travels the distance A between the upstream heating element 203 and the heating element 204. Then, it is given heat by the heating element 204. The left side of Formula (14) is the sum of the amount of electric power, which is equivalent to the amount of heat given to the point Y by the upstream heating element 203, the amount of electric power, which is equivalent to the amount of heat given to the point Y by the heating element 204, and the amount of electricity which is equivalent to the amount of heat given to the point Y by the downstream heating element 203. The heating element 203 was made to branch in such a manner that the ratio in electrical resistance between the upstream and downstream heating elements 203 and 203 became 1:1. The right side of Formula (14) is the ratio by which electric power is supplied to the three heating elements per control cycle, like the one in the first embodiment, that is, the ratio of the total amount of electric power which is to be switch according to the temperature level detected by the thermistor during an image forming operation. Further, in a case where the image forming apparatus is provided with two or more recording medium conveyance speeds, the following Formula (15) is used in combination with Formula (14):

$$\frac{E_{203}(t)}{2} + E_{204}\left(t + \frac{A}{V2}\right) + \frac{E_{203}\left(t + \frac{A+B}{V2}\right)}{2} \cong Pin \tag{15}$$

In this embodiment, the recording medium conveyance speed V1 was 200 mm/sec, and the distance A between the heating elements 203 and 204 was 2 mm. The distance B between the heating element 204 and the downstream heating element 3 was 2 mm. Further, R203 and R204 were 17Ω and 27Ω, respective. The frequency of the commercial electric power source was 50 Hz. That is, the specification of the apparatus and the condition under which the apparatus was operated were the same as those in the second embodiment. P203(*t*) and P204(*t*) were set so that Formula (14) was satisfied under the above described condition. Further, also in a case where the recording conveyance speed V2 was set to 100 mm/sec, the P203(*t*) and P204(*t*) were set so that Formula (14) was satisfied. In other words, the control pattern was set according to the recording medium conveyance speed. The P203(*t*) and P204(*t*) were set with 2.5% interval, so that the positive and negative sides of the combination of the electric currents which flow through the three heating elements, one for one, become symmetrical in waveform. Therefore, all that is necessary is to set the control tables to minimize the difference between the left and the right (Pin) sides of Formula (14) and the difference between the left and right (Pin) sides of Formula (15); it is not mandatory that the left side of Formula (14) and the left side of Formula (15) become equal to the amount (ratio) Pin by which heater is to be supplied with electric power.

FIG. 16 is the control pattern in this embodiment, which was set under the condition described above, in order to minimize the nonuniform fixation (when electric power level Pin=50%). In this embodiment, it was the control pattern for the heating element 203 that was set first. Then, the control pattern for the heating element 204 was set (by calculation) so that Formulas (14) and (15) were satisfied. FIG. 16(*a*) shows an example of the actual control pattern which was used when the recording medium conveyance speed was V1. The lengthwise of time it takes for the point Y of a sheet of recording medium to travel the distance A between the upstream heating elements 203 and the heating element 204 is 10 msec, and so is the length of time it takes for the point Y of the sheet to travel the distance B between the heating element 204 and the downstream 203. Since the length of time, which is equivalent to half the oscillatory cycle of the AC power source which was 50 Hz is 10 msec, Formula (12) was applied to Formula (14) as in the first embodiment.

That is, $$\frac{E_{203}(t_n)}{2} + E_{204}(t_{n+1}) + \frac{E_{203}(t_{n+2})}{2} \cong Pin$$

Even if the length of time it takes for the point Y of a sheet of recording medium travel the distance A between the upstream heating element 203, or the distance B between the heating element 204 and the downstream heating element 203, is different from the length of time equivalent to half the cycle (half waveform) of the AC power source, Formula (14) may be used, as long as the difference is within the length of time equivalent to the rated frequency of the AC power source.

For example, P203(*t*1) and P204(*t*1) are both 50%. Thus, (E203(*t*1)/2+E204(*t*3)/2), which is the ratio by which heat is to be generated by the heating element 203 (by which electric power is to be supplied to heating element 203) is 30.68%, which is obtainable from Formula (I). The ratio by which electric power is to be supplied to the heating element 204 at a point t2 in time, that is, A/V1 seconds after the point t1 in time, has only to be 19.32%, which is obtainable from Formula (14). Converting this figure, P204(*t*2) was set to 50%, which is minimum in error, with the interval being 2.5%. As described above, P204(*t*1)-P204(*t*8) were obtained based on the control pattern for the heating element 203. Obviously, the heating element 204 may be the first heating element for which the control pattern is set. In such a case, the control pattern for the heating element 203 is set (by calculation) according to the control pattern for the heating element 204.

FIG. 16(*b*) shows an example of the control pattern to be used when the recording medium conveyance speed is V2. The length of time it takes of the point Y of a sheet of recording medium to travel between the upstream heating element 203 and the downstream heating element 203 under the above-described condition is 20 msec. Thus, the calculation was made by applying Formula (13) to Formula (15) as in the third embodiment.

That is, the calculation was made so that the following formula was satisfied:

$$\frac{E_{203}(t_n)}{2} + E_{204}(t_{n+2}) + \frac{E_{203}(t_{n+4})}{2} \cong Pin$$

The method for setting the control pattern for the heating element 204 by calculation, is the same as the above described one, and therefore, is not described in detail.

Figure 17:
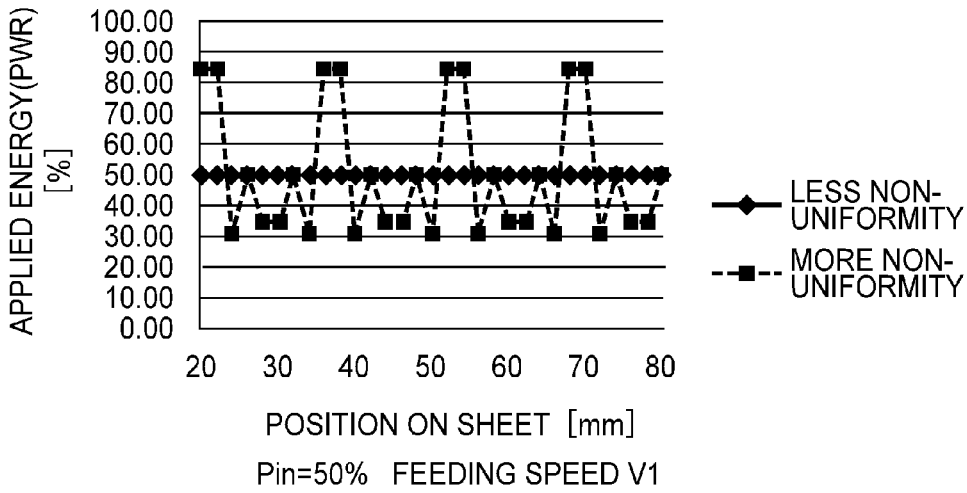
FIG. 17 is a graph which shows the relationship between a given point of a sheet of recording medium in terms of the recording medium conveyance direction, and the amount of electric power (which is equivalent to amount of heat given to given point of sheet of recording medium) supplied to the heating elements in the fourth embodiment.
Figure 17:
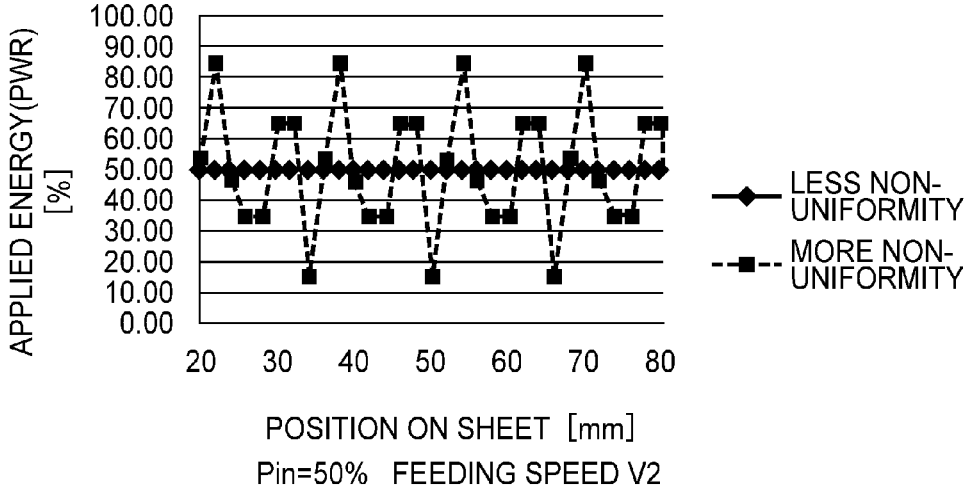

Next, referring to FIGS. 17(*a*) and 17(*b*), the effects of this embodiment upon the minimization of the nonuniform fixation is described. The graphs in FIGS. 17(*a*) and 17(*b*) show the amounts by which electric power was supplied to the heater while various points of a sheet of recording medium moved by the heater while the recording medium speeds were V1 and V2, respectively. The axis of ordinates stands for the amount (which is expressed in relative value) by which electric power was supplied to the heater, which is equivalent to the "sum of the amount of heat given to a given point of the sheet of recording medium by the combination of three heating elements". The dotted line represents the case in which the electric power was controlled in a control pattern set without taking Formulas (14) into consideration. The solid line represents the case in which the electric power was controlled in the control pattern shown in FIG. 16, that is, the pattern set in consideration of Formulas (14). In this case, the amount of electric power is expressed in terms of the ratio relative to the value of the dotted line. In the case of the control pattern indicated by the dotted line, the difference between the largest amount by which electric power was supplied to the heater when a give area of the sheet of recording medium was moved past the heater, and the smallest amount by which electric power was supplied to the heater when the given area of the sheet was moved past the heater, is rather large. In comparison, in the case of the control pattern represented by the solid line, the difference is relatively small. As is evident from the distribution of the amount by which electric power was applied, across the sheet S, the electric power supply control in this embodiment is effective to minimize the nonuniform fixation. The flowchart of the control sequence in this embodiment is the same as the one shown in FIG. 13. That is, its description is the same as that of the flowchart in FIG. 13. Therefore, it is not described here.

As described above, the present invention can enable even an image forming apparatus (fixing device), one of the multiple (two) heating elements of which bifurcates as if the heater of its fixing device has three heating elements, to output a print (image) which is virtually free of nonuniform fixation.

Embodiment 6

The structure of the image forming apparatus in this embodiment is the same as that of the image forming apparatus in the first embodiment, although the electric power supply to the heater of the fixing device of this apparatus is not switched in the control pattern (electric power table) even after the apparatus is switched in the recording medium conveyance speed. The structure of the heater in this embodiment is the same that in the fourth embodiment, which is shown in FIG. 3(*d*). The recording medium conveyance speeds V1 and V2 also are the same as those in the fourth embodiment.

In order to make the image forming apparatus in this embodiment virtually free of nonuniform fixation, the electric power table has to be set so that the total amount by which the heater is supplied with electric power satisfy both Formula (14) and (15), as in the above described fourth embodiment.

FIG. 18 shows an example of the actual control pattern in this embodiment (Pin=50%). The recording medium conveyance speed V1 was set to 200 mm/sec. Thus, the length of time it takes for the point Y of a sheet of recording medium travel across the distance A between the upstream heating elements 203 and the heating element 204 was 10 msec, which is equivalent to half the oscillatory cycle of the AC power source which is 50 Hz in frequency. The length of time it takes for the point Y of the sheet to travel the distance B between the heating element 204 and the downstream heating element 203 is also 10 msec. The recording medium conveyance speed V2 was 100 mm/sec. Therefore, the length of time it takes for the point Y of the sheet of recording medium to travel the distance A between the upstream heating element 203 and the heating element 204, or the distance B between the heating element 204 and the downstream heating element 203 is 20 msec, which is equivalent to each cycle of the AC power source which is 50 Hz in frequency. Further, even when the length of time it takes for the point Y of the sheet of recording medium to travel aforementioned distance A or B is different from the length of time equivalent to half of each cycle (half of waveform of each cycle), Formula (14) was used for calculation, as long as the difference fell within the length of time equivalent to the rated frequency.

For example, when the recording medium conveyance speed is V1, P203(*t*) and P203(*t*5) are 0% and 100%. Therefore, E203(*t*3)/2+E203(*t*5)/2 is 30.68%. Thus, the ratio of the amount by which electric power is given to the heating element 204 at a point t in time, that is, A/V1 seconds after the point in time at which electric power begins to be supplied to the upstream heating element 203, is 19.32% (=50%-30.68%). Converting this figure into amount of electric power, E204(*t*4) is desired to be 50%, which is smallest in error, measured in a unit (interval) of 2.5%. On the other hand, when the recording medium conveyance speed is V2, E203(*t*2)/2+E203(*t*6)/2 is 15.34%. Therefore, in order for Pin to be 50%, E204(*t*4) has to be 34.66%. Converting this figure, the ratio of the electric power is 90%, which is the smallest I error, with unit of measurement being 2.5%. Here, P204(*t*4) was set to 70%, which is between 50% and 90%, in order to assure that even if the recording medium conveyance speed is switched from V1 to V2, this embodiment remains effective to prevent the nonuniform fixation. As described above, P204(*t*1-P204(*t*8) were obtained based on the control pattern for the heating element 203. Needless to say, the control pattern for the heating element 204 may be the first control pattern to be set, so that the control pattern for the heating element 203 can be set according to the control pattern for the heating element 204.

Figure 19:
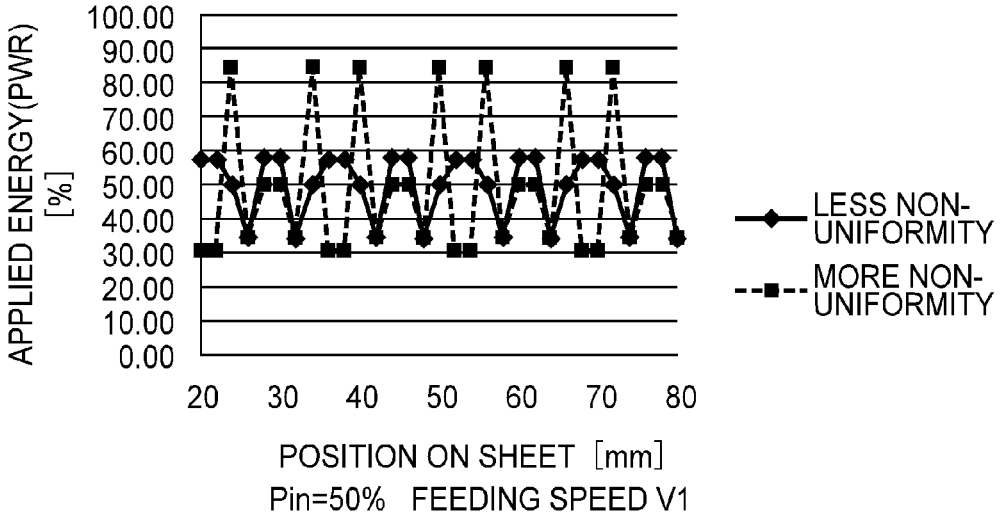
FIG. 19 is a graph which shows the relationship between a given point of a sheet of recording medium in terms of the recording medium conveyance direction, and the amount of electric power (which is equivalent to amount of heat given to given point of sheet of recording medium) supplied to the heating element in the sixth embodiment.
Figure 19:
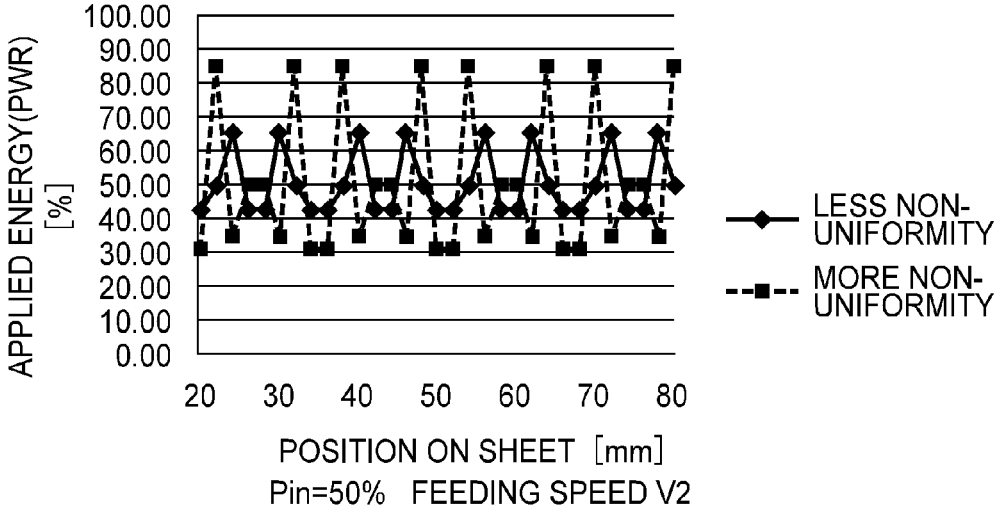

Next, referring to FIGS. 19(*a*) and 19(*b*), the effects of this embodiment of the present invention upon the reduction of the nonuniform fixation is described. The graph in FIG. 19(*a*) shows the relationship between the amount (%) by which electric power is supplied to the heater, and various points of a sheet of recording medium from its leading edge in terms of the recording medium conveyance direction, when the recording medium speed was V1. The graph in FIG. 19(*b*) shows the same as the one shown in FIG. 19(*a*), when the recording medium conveyance speed was V2. The solid lines in the graphs represent the case in which the electric power for the heater was controlled in the control pattern, shown in FIG. 18, which was set in consideration of Formula (14). The amounts (%) are values relative to the amount by which electric power was supplied to the heater in the case represented by the dotted line. In the case of the control pattern represented by the dotted lines, the difference between the largest and smallest amounts by which electric power is supplied to each of multiple heating elements of the heater while a sheet of recording medium was conveyed through the fixation nip is substantial. In comparison, in the case of the control pattern represented by the solid lines, the difference is small. The difference is not as small as that in the fourth embodiment. However, as long as the difference is small enough to enable an image forming apparatus to output an image, the nonuniform of which attributable to nonuniform fixation is virtually undetectable by naked eyes, there is no problem. Further, in a case where the recording medium conveyance speed V2 is such a speed that makes it unlikely for nonuniform fixation to occur, the control pattern may be set in consideration of only the recoding medium speed V1, which is greater in the effect upon nonuniform fixation than the recording medium conveyance speed V2.

The flowchart of the electric power supply control sequence in this embodiment is the same as that shown in FIG. 10. That is, its description is the same as the description of the flowchart in FIG. 10, and therefore, is not given here.

As is evident from the description of this embodiment given above, this embodiment is effective to significantly reduce an image forming apparatus provided with multiple recording conveyance speeds, in the nonuniform fixation, with the use of only one control pattern.

The preceding embodiments of the present invention may be used in combination, as long as the combination does not have adverse effects.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 125023/2012 and 094192/2013 filed May 31, 2012 and Apr. 26, 2013, respectively which are hereby incorporated by reference.

What is claimed is:

1. An image forming apparatus comprising:

an image forming station for forming an unfixed image on a recording material;

a fixing portion for fixing an unfixed image formed on the recording material thereon, said fixing portion including an endless belt, a heater contacted to an inner surface of said endless belt, a back-up member forming a fixing nip for nipping and feeding the recording material together with said heater through said endless belt, said heater including a first heat generating element and a second heat generating element provided at a position downstream of said first heat generating element with respect to a feeding direction of the recording material; and an electric power control portion for controlling electric power supplied to said first heat generating element and said second heat generating element in accordance with a temperature of the fixing portion;

wherein said electric power control portion supplies the electric power to said first heat generating element and said second heat generating element so that a feeding speed V1 of the recording material at the fixing nip, a distance A between said first heat generating element and said second heat generating element, a ratio Pin (%) of total electric power supplied to said first heat generating element and said second heat generating element set in accordance with the temperature of said fixing portion relative to maximum total electric power supplyable to said first heat generating element and said second heat generating element, a ratio E203(*t*) (%) of electric power supplied to said first heat generating element at timing t relative to the maximum total electric power, and a ratio E204(*t*) (%) of electric power supplied to said second heat generating element at timing t relative to the maximum total electric power, satisfy the following equation, $$E_{203}(t) + E_{204}\left(t + \frac{A}{V1}\right) \cong Pin.$$

2. An apparatus according to claim 1, wherein said electric power control portion is capable of controlling said first heat generating element and said second heat generating element independently from each other.

3. An apparatus according to claim 2, wherein a waveform of current flowing through said second heat generating element under the control of said electric power control portion is different from a waveform of current flowing through said first heat generating element under the control of said electric power control portion.

4. An apparatus according to claim 1, wherein said apparatus is capable of setting a speed V2 which is different from the speed V1, and wherein said electric power control portion controls the electric power so as to satisfy the equation in at least one of a case in which the speed is V1 during fixing and a case in which the speed is V2 during fixing.

5. An apparatus according to claim 4, wherein said electric power control portion controls the electric power so as to satisfy the equation in both of said cases.

6. An apparatus according to claim 1, wherein said electric power control portion controls the electric power so that the left-hand side of the equation falls within ±20 points relative to the right-hand side of the equation.

7. An apparatus according to claim 1, wherein said electric power control portion controls the electric power so that said equation is satisfied at least in a range of 30%≤Pin≤80%.

8. An apparatus according to claim 1, wherein waveforms of the currents flowing through said first heat generating element and said second heat generating element each includes mixed phase control waveform and wave number control waveform.

9. An image forming apparatus comprising:

an image forming station for forming an unfixed image on a recording material;

a fixing portion for fixing an unfixed image formed on the recording material thereon, said fixing portion including an endless belt, a heater contacted to an inner surface of said endless belt, a back-up member forming a fixing nip for nipping and feeding the recording material together with said heater through said endless belt, said heater including a first heat generating element and a second heat generating element provided at a position downstream of said first heat generating element with respect to a feeding direction of the recording material; and an electric power control portion for controlling electric power supplied to said first heat generating element and said second heat generating element in accordance with a temperature of the fixing portion, said electric power control portion selecting an electric power level Pin (%) from a plurality of electric power levels in accordance with a temperature of the fixing portion, for each control cyclic period comprising a plurality of successive half-cycles of an AC waveform;

wherein at least one electric power level of the plurality of electric power levels is set so that a feeding speed V1 of the recording material at the fixing nip, a distance A between said first heat generating element and said second heat generating element, a ratio E203(*t*) (%) of electric power supplied to said first heat generating element at timing t, and a ratio E204(*t*) (%) of electric power supplied to said second heat generating element at timing t, satisfy the following equation, $$E_{203}(t) + E_{204}\left(t + \frac{A}{V1}\right) \cong Pin.$$

10. An apparatus according to claim 9, wherein said electric power control portion is capable of controlling said first heat generating element and said second heat generating element independently from each other.

11. An apparatus according to claim 10, wherein said electric power control portion comprises a first electric power table including the plurality of electric power levels for said first heat generating element, and a second electric power table including the plurality of electric power levels.

12. An apparatus according to claim 11, wherein said apparatus is capable of setting a speed V2 which is different from the speed V1, and wherein said first electric power table and said second electric power table are set so as to satisfy the equation in at least one of a case in which the speed is V1 during fixing and a case in which the speed is V2 during fixing.

13. An apparatus according to claim 12, wherein said first electric power table and said second electric power table are set so as to satisfy the equation in both of said cases.

14. An apparatus according to claim 11, wherein said apparatus is capable of setting a speed V2 which is different from the speed V1, and wherein said first electric power table and said second electric power table are set for each of the speeds.

15. An apparatus according to claim 11, wherein said first electric power table and said second electric power table are set so that the left-hand side of the equation falls within ±20 points relative to the right-hand side of the equation.

16. An apparatus according to claim 15, wherein the equation is satisfied at least 75% duration in said one control cyclic period.

17. An apparatus according to claim 11, wherein said first and second electric power tables are set so that said equation is satisfied at least in a range of 30%≤Pin≤80%.

18. An apparatus according to claim 11, wherein in said first electric power table and said second electric power table, a positive polarity waveform and a negative polarity waveform in one control cyclic period are symmetrical with each other.

19. An apparatus according to claim 9, wherein waveforms of the currents flowing through said first heat generating element and said second heat generating element each includes mixed phase control waveform and wave number control waveform.

* * * * *